US011300382B2

(12) United States Patent
Holly

(10) Patent No.: US 11,300,382 B2
(45) **Date of Patent: *Apr. 12, 2022**

(54) FIREARM OPTICAL SIGHT ADAPTER

(71) Applicant: Michael Buchanan Holly, Richmond Hill, GA (US)

(72) Inventor: Michael Buchanan Holly, Richmond Hill, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/185,872

(22) Filed: Feb. 25, 2021

(65) Prior Publication Data

US 2021/0318099 A1 Oct. 14, 2021

Related U.S. Application Data

(63) Continuation-in-part of application No. 16/845,057, filed on Apr. 9, 2020, now Pat. No. 11,002,517.

(51) Int. Cl.
*F41G 1/26* (2006.01)
*F41G 1/46* (2006.01)

(52) U.S. Cl.
CPC *F41G 1/26* (2013.01); *F41G 1/46* (2013.01)

(58) Field of Classification Search
CPC ..... F41G 1/16; F41G 1/26
See application file for complete search history.

(56) References Cited

U.S. PATENT DOCUMENTS

| | | | |
|---|---|---|---|
| 6,327,806 | B1 | 12/2001 | Paige |
| 7,946,074 | B2 | 5/2011 | Elpedes |
| 8,082,688 | B2 | 12/2011 | Elpedes |
| 8,832,983 | B1 | 9/2014 | Wolf |
| 9,046,320 | B2 | 6/2015 | Keng |
| 9,062,936 | B2 | 6/2015 | Zimmer |
| 9,354,022 | B2 | 5/2016 | Eriksson |
| 9,410,770 | B2 | 8/2016 | Zimmer |
| 9,506,726 | B2 | 11/2016 | Wolf |
| 9,574,853 | B2 | 2/2017 | Crispin |
| 9,696,114 | B1 | 7/2017 | Cabrera |
| 9,863,740 | B2 | 1/2018 | Wolf |
| 10,024,628 | B2 | 1/2018 | Toner |
| 10,036,613 | B2 | 7/2018 | Huff |

(Continued)

FOREIGN PATENT DOCUMENTS

| | | |
|---|---|---|
| CN | 207751390 U | 8/2018 |
| CN | 210089500 U | 2/2020 |

(Continued)

OTHER PUBLICATIONS

Instagram screen images, published Feb. 1, 2019 and Mar. 20, 2019, obtained Jun. 29, 2020.

*Primary Examiner* — Reginald S Tillman, Jr.
(74) *Attorney, Agent, or Firm* — Kevin M. Able

(57) ABSTRACT

A firearm optical sight adapter is disclosed. The optical sight adapter can include an adapter plate with first and second opposing mounting surfaces, and a registration pin extending orthogonally from the first mounting surface. The optical sight adapter may further include a socket having a recess extending from the second mounting surface to a bottom wall intermediate between the first and mounting surfaces and an aperture extending from the bottom wall of the recess through the first mounting surface along a first longitudinal axis. A removable mounting post can be configured to engage in the socket. The optical sight adapter may include a recoil buffer extending upright from the first surface.

23 Claims, 22 Drawing Sheets

(56) References Cited

U.S. PATENT DOCUMENTS

| | | | |
|---|---|---|---|
| 10,352,654 | B2 | 7/2019 | Costet |
| D868,923 | S | 12/2019 | Toner |
| 10,563,955 | B2 | 2/2020 | Pniel |
| 2005/0057808 | A1 | 3/2005 | Houde-Walter |
| 2007/0234625 | A1 | 10/2007 | Kidd |
| 2008/0062487 | A1 | 3/2008 | Houde-Walter |
| 2013/0219767 | A1 | 8/2013 | Peterson |
| 2013/0283660 | A1 | 10/2013 | Matthews |
| 2014/0109456 | A1 | 4/2014 | Jung |
| 2014/0150325 | A1 | 6/2014 | Keng |
| 2014/0230305 | A1 | 8/2014 | Zimmer |
| 2015/0268002 | A1 | 9/2015 | Jeung |
| 2015/0276350 | A1 | 10/2015 | Zimmer |
| 2016/0102943 | A1 | 4/2016 | Teetzel |
| 2016/0334193 | A1 | 11/2016 | Zimmer |
| 2017/0059277 | A1 | 3/2017 | Justice |
| 2018/0195835 | A1 | 7/2018 | Crispin |
| 2019/0049217 | A1 | 2/2019 | Costet |
| 2019/0257620 | A1 | 8/2019 | Zimmer |
| 2019/0331461 | A1 | 10/2019 | Zimmer |
| 2020/0025520 | A1 | 1/2020 | Niswander |
| 2021/0231407 | A1 | 7/2021 | Salinas |

FOREIGN PATENT DOCUMENTS

| | | | |
|---|---|---|---|
| EP | 2982927 | A1 | 2/2016 |
| FR | 2611036 | A1 | 8/1988 |
| WO | 2982927 | A1 | 1/2013 |

FIREARM OPTICAL SIGHT ADAPTER

CROSS-REFERENCE TO RELATED PATENT APPLICATION

This application is a continuation-in-part of U.S. application Ser. No. 16/845,057 filed on Apr. 9, 2020, the content of which is incorporated herein by reference in its entirety.

FIELD

The present disclosure is directed to an adapter configured to mate an optical sight to a firearm, and more particularly to a handgun, such as a semi-automatic handgun comprising a reciprocating slide.

BACKGROUND

It is known to mount electronic sights to a firearm. As used herein, an electronic sight is a firearm sight using an electrically powered light source to project an aiming indicium onto an optical element serving as a viewing screen to the shooter. Such sights may also be referred to as e.g., reflective ("reflex") sights or red-dot sights. Electronic sights can provide fast target acquisition, are theoretically parallax-free, useable in adverse environments such as low-light conditions and can overcome the limitations of aging eyesight. The advent of small, rugged electronic sights has allowed electronic sights to be mounted on a variety of firearms, and in particular, mounted on the slide of a semi-automatic handgun, wherein such sighting devices are capable of surviving the harsh recoil imparted to the sight associated with the reciprocating slide during firing.

In many instances, the handgun slide can be modified, for example, by using common machining methods to mill a recess into the slide, the recess configured to accept an electronic sight with a predetermined footprint. Slide modification can be undertaken by the firearm manufacturer or by a competent gunsmith post-manufacture. However, such modifications are permanent, and using a different electronic sight with a different footprint may require further modification of the slide, which may not be possible. Moreover, given the large assortment of slide designs from an expansive number of firearm manufacturers, it would be impractical for electronic sight manufacturers to modify electronic sight designs to accommodate the many firearm configurations. Similarly, it would be prohibitive for firearm manufacturers to produce a different version firearm for each available electronic sight design. Accordingly, an interface device mounted between the handgun slide and the electronic sight can provide an inexpensive bridge between a particular handgun and a given electronic sight. A change to the electronic sight, for example switching to an electronic sight from a different manufacturer with a different footprint, can be accomplished with a simple change of the interface device, thereby allowing a larger assortment of electronic sights to be used with a given firearm than if an interface device was not used.

Traditional sight adapters for handguns are typically flat plates secured to the handgun by threaded fasteners. Once the adapter plate is secured to the handgun, an electronic sight can then be secured to the adapter plate by inserting additional threaded fasteners through passages in the electronic sight body and engaging the threaded fasteners in threaded apertures extending through a thickness of the adapter plate only. Unfortunately, because such adapter plates are typically thin, a limited number of threads are available to engage with these additional fasteners, limiting the robustness of the coupling and providing a potential failure point. On the other hand, a thicker adapter plate providing more thread engagement can raise the electronic sight relative to existing iron sights, thereby either impairing the use of the existing iron sights for co-witnessing (acquiring the target simultaneously with both the iron sights and the electronic slight) or necessitating replacement of existing iron sights with taller iron sights. Taller iron sights, particularly the front sight located on the forward end of the slide, are more susceptible to damage and more prone to snagging, for example on clothing.

SUMMARY

A firearm optical sight adapter is disclosed, comprising an adapter plate including a first mounting surface and a second mounting surface opposite the first mounting surface, a registration pin integral with the mounting plate and extending orthogonally from the first mounting surface, and a socket comprising a recess extending from the second mounting surface to a bottom wall located intermediate between the first mounting surface and the second mounting surface and an aperture extending from the bottom wall of the recess through the first mounting surface along a first longitudinal axis, and wherein a periphery of the recess is not circularly symmetric relative to the first longitudinal axis. That is, for a line segment extending from the first longitudinal axis to the periphery of the recess, as the line segment is rotated about the first longitudinal axis, a length of the line segment varies.

The firearm optical sight adapter may further comprise a mounting post removably engaged in the socket, the mounting post comprising a flange and a shaft extending from the flange through the first aperture, the shaft terminating a distance R beyond the first mounting surface, the mounting post further defining a threaded passage extending along a second longitudinal axis coaxial with the first longitudinal axis. R can be equal to or greater than about 1 millimeter (mm), for example in a range from about 1 mm to about 3.5 mm, such as in a range from about 1.2 mm to about 3 mm, for example in a range from about 1.5 mm to about 2.7 mm, or in a range from about 2 mm to about 2.7 mm including all ranges and subranges therebetween. In various embodiments, a shape of the flange can be complementary to a shape of the recess, and wherein the recess and the flange can be configured to resist rotation of the mounting post about the first longitudinal axis when a torque is applied to the mounting post.

The adapter plate further comprises a first end and a second end opposite the first end, and a recoil buffer integral with the mounting plate and disposed at the first end of the mounting plate, the recoil buffer extending upright from the first surface. In some embodiments, the recoil buffer can comprise an arcuate surface facing the second end. For example, the arcuate surface can comprise a first curvature in a first direction. In some embodiments, the arcuate surface can comprise a second curvature orthogonal to the first curvature.

In various embodiments, the first end and the second end define a length of the adapter plate therebetween, and a height of the recoil buffer relative to the first mounting surface can be at least 0.25 times the length of the adapter plate, for example at least about 0.3 times the length of the adapter plate. The recoil buffer can define an opening positioned between a first side member and a second side member, a cross-member extending above the opening between a top of the first side member and a top of the second side member.

In some embodiments, the adapter plate may further comprise a side edge surface between the first end and the second end, the side edge comprising a chamfer intersecting the second mounting surface.

In still other embodiments, a firearm optical sight adapter is described, comprising an adapter plate comprising a first mounting surface, a second mounting surface opposite the first mounting surface, and a first end and a second end opposite the first end, the first end and the second end defining a length therebetween. The adapter plate may further comprise a registration pin integral with the adapter plate and extending orthogonally from the first mounting surface and a recoil buffer integral with the mounting plate disposed at the first end of the mounting plate, the recoil buffer extending upright from the first mounting surface and comprising a height above the first mounting surface greater than about 0.25 times the length of the adapter plate, the recoil buffer comprising a frame defining an opening therethrough.

The adapter plate may still further comprise a socket comprising a recess extending from the second mounting surface to a bottom wall located intermediate between the first mounting surface and the second mounting surface and an aperture extending along a first longitudinal axis from the bottom wall of the recess through the first mounting surface. In some embodiments, a periphery of the recess is not circularly symmetric relative to the first longitudinal axis. That is, for a line segment extending from and orthogonal to the first longitudinal axis and terminating at the periphery of the recess, as the line segment is rotated about the first longitudinal axis, a length of the line segment varies.

In various embodiments, the firearm optical sight adapter may further comprise a mounting post removably engaged in the socket, the mounting post comprising a flange and a shaft extending from the flange through the second aperture, the shaft terminating at least about 1 mm beyond the first mounting surface. The mounting post may define a threaded passage extending along a second longitudinal axis, the second longitudinal axis coaxial with the first longitudinal axis. A shape of the flange can be complementary to a shape of the recess, wherein the recess and the flange are configured to resist rotation of the mounting post about the longitudinal axis of the shaft when a torque is applied to the mounting post. In various embodiments, a periphery of the flange is not circularly symmetric with the first longitudinal axis. That is, for a line segment extending from and orthogonal to the first longitudinal axis and terminating at the periphery of the flange, as the line segment is rotated about the first longitudinal axis, a length of the line segment varies.

In some embodiments, the recoil buffer can comprise an arcuate surface facing in a direction toward the second end, the arcuate surface comprising a first curvature in a first direction. In some embodiments, the arcuate surface may further comprise a second curvature orthogonal to the first curvature.

In some embodiments, the opening can be bounded by a frame comprising a first side member, a second side member opposite the first side member, and a cross-member extending from a top of the first side member to a top of the second side member, a bottom surface of the cross member comprising an upwardly convex curvature that defines a top of the opening.

The firearm optical sight adapter may further comprise a recess in the front end of the adapter plate, the recess intersecting the second mounting surface.

In yet other embodiments, a firearm optical sight adapter is disclosed, comprising an adapter plate comprising a first mounting surface, a second mounting surface opposite the first mounting surface, a first end and a second end opposite the first end, the first end and the second end defining a length therebetween, and a registration pin integral with the adapter plate and extending orthogonally from the first mounting surface. The adapter plate may further comprise a recoil buffer integral with the mounting plate disposed at the first end of the mounting plate, the recoil buffer extending upright from the first mounting surface a distance of at least 0.25 times the length of the adapter plate and comprising a D-shaped opening therein.

The adapter plate may include a socket comprising a recess extending from the second mounting surface to a bottom wall located intermediate between the first mounting surface and the second mounting surface and an aperture extending along a first longitudinal axis from the bottom wall of the recess through the first mounting surface. In various embodiments, the recess is not circularly symmetric relative to the first longitudinal axis. That is, for a line segment extending from and orthogonal to the first longitudinal axis and terminating at the periphery of the recess, as the line segment is rotated about the first longitudinal axis, a length of the line segment varies.

The firearm optical sight adapter may further comprise a mounting post removably engaged in the socket, the mounting post comprising a flange and a shaft extending from the flange through the second aperture, the shaft terminating at least about 1 mm beyond the first mounting surface, the mounting post further defining a threaded passage extending along a second longitudinal axis, the second longitudinal axis coaxial with the first longitudinal axis.

In various embodiments, a shape of the flange can be complementary to a shape of the recess, and wherein the recess and the flange are configured to resist rotation of the mounting post about the first longitudinal axis when a torque is applied to the mounting post.

In some embodiments, the adapter plate may further comprise a recess extending across a width of the adapter plate defined between a first side edge surface and a second side edge surface, the recess positioned below the D-shaped opening and intersecting the second mounting surface.

The adapter plate may further comprise a registration pin integral with the adapter plate and extending orthogonally from the first mounting surface.

In still other embodiments, a firearm is disclosed, the firearm comprising a frame and a slide slidingly engaged with the frame, the slide comprising a recessed area. An optical sight adapter can be positioned in the recessed area and coupled to the slide, the optical sight adapter comprising an adapter plate with a first mounting surface, a second mounting surface opposite the first mounting surface, and a first end and a second end opposite the first end, the first end and the second end defining a length therebetween. The adapter plate may further comprise a registration pin integral with the adapter plate and extending orthogonally from the first mounting surface and a recoil buffer integral with the mounting plate disposed at the first end of the mounting plate, the recoil buffer extending upright from the first mounting surface and comprising a height above the first mounting surface greater than about 0.25 times the length of the adapter plate, for example at least about 0.30 times the length of the adapter plate, such as at least about 0.45 times the length of the adapter plate, the recoil buffer comprising a frame defining an opening therethrough.

The adapter plate may still further comprise a socket comprising a recess extending from the second mounting surface to a bottom wall located intermediate between the first mounting surface and the second mounting surface and an aperture extending along a first longitudinal axis from the bottom wall of the recess through the first mounting surface. In some embodiments, a periphery of the recess is circularly asymmetric relative to the first longitudinal axis. That is, for a line segment extending from and orthogonal to the first longitudinal axis and terminating at the periphery of the recess, as the line segment is rotated about the first longitudinal axis, a length of the line segment varies.

In various embodiments, the firearm optical sight adapter may further comprise a mounting post removably engaged in the socket, the mounting post comprising a flange and a shaft extending from the flange through the second aperture, the shaft terminating at least about 1 mm beyond the first mounting surface. The mounting post may define a threaded passage extending along a second longitudinal axis, the second longitudinal axis coaxial with the first longitudinal axis. A shape of the flange can be complementary to a shape of the recess, wherein the recess and the flange are configured to resist rotation of the mounting post about the longitudinal axis of the shaft when a torque is applied to the mounting post. In various embodiments, a periphery of the flange is not circularly symmetric with the first longitudinal axis. That is, for a line segment extending from and orthogonal to the first longitudinal axis and terminating at the periphery of the flange, as the line segment is rotated about the first longitudinal axis, a length of the line segment varies.

In some embodiments, the recoil buffer can comprise an arcuate surface facing in a direction toward the second end, the arcuate surface comprising a first curvature in a first direction. In some embodiments, the arcuate surface may further comprise a second curvature orthogonal to the first curvature.

In some embodiments, the opening can be bounded by a frame comprising a first side member, a second side member opposite the first side member, and a cross-member extending from a top of the first side member to a top of the second side member, a bottom surface of the cross member comprising an upwardly convex curvature that defines a top of the opening.

The firearm optical sight adapter may further comprise a recess in the front end of the adapter plate, the recess intersecting the second mounting surface.

In still another embodiment, a kit of parts for mounting an optical sight to a firearm is disclosed, the kit comprising an adapter plate comprising a first mounting surface and a second mounting surface opposite the first mounting surface, the adapter plate further comprising a socket comprising a recess extending from the second mounting surface to a bottom wall located intermediate between the first mounting surface and the second mounting surface and an aperture extending from the bottom wall of the recess through the first mounting surface along a first longitudinal axis, and a mounting post comprising a flange and a shaft extending from the flange, the shaft comprising an interior threaded passage extending along a second longitudinal axis, the mounting post configured to engage in the socket such that the shaft extends orthogonally through the aperture and above the first mounting surface, the mounting post configured to resist rotation when engaged in the socket and subjected to a torque.

In some embodiments, the shaft can extend at least about 1 mm above the first mounting surface when the mounting post is engaged in the socket.

In some embodiments, the adapter plate may further comprise a recoil buffer extending upright from the first mounting surface, a width of the recoil buffer equal to or greater than about 0.5 times a width of the adapter plate defined between a first side edge and a second side edge of the adapter plate.

In various embodiments, a shape of the flange can be complementary to a shape of the recess. For example, a periphery of the recess can be circularly asymmetric relative to the longitudinal axis, although in further examples the periphery of the recess can be circularly symmetric. For example, the shaft of the mounting post may comprise at least one ridge disposed along at least a portion of a length thereof that causes the mounting post to resist rotation.

In some embodiments, the adapter plate may comprise a second socket comprising a second recess extending from the second mounting surface to a second bottom wall located intermediate between the first mounting surface and the second mounting surface and a third aperture extending from the second bottom wall through the first mounting surface along a third longitudinal axis, and wherein a periphery of the second recess is circularly symmetric relative to the third longitudinal axis. The kit may further comprise a removable registration pin comprising a flange and a shaft extending from the flange, the removable registration pin configured to engage in the second socket. The removable registration pin may be configured so as not to resist rotation but may be sized to provide an interference fit within the second socket so that the registration pin can be retained in the socket until removal is desired.

Additional features and advantages of the embodiments disclosed herein will be set forth in the detailed description that follows, and in part will be clear to those skilled in the art from that description or recognized by practicing the embodiments described herein, including the detailed description which follows, the claims, as well as the appended drawings.

Both the foregoing general description and the following detailed description present embodiments intended to provide an overview or framework for understanding the nature and character of the embodiments disclosed herein. The accompanying drawings are included to provide further understanding and are incorporated into and constitute a part of this specification. The drawings illustrate various embodiments of the disclosure, and together with the description explain the principles and operations thereof.

DETAILED DESCRIPTION

Figure 1:
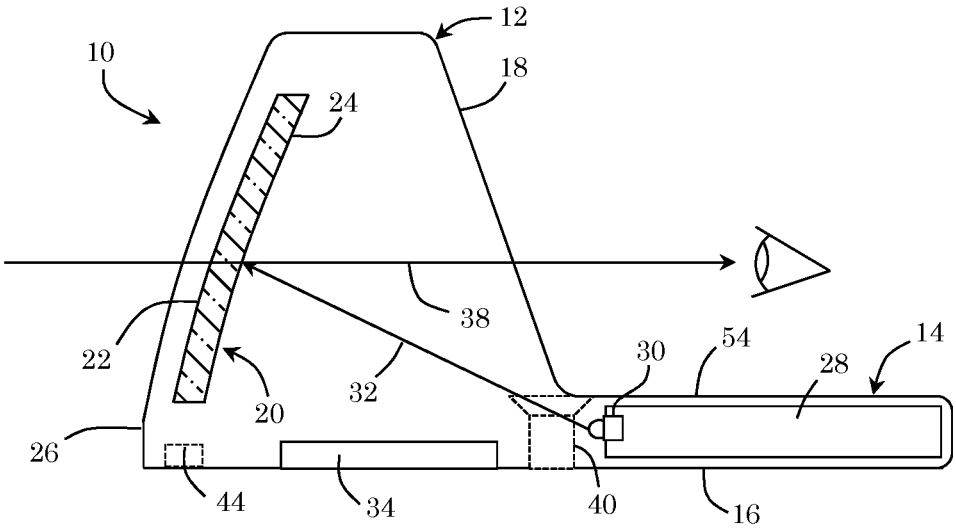
FIG. 1 is a schematic drawing of an exemplary optical (e.g., electronic) sight.

Reference will now be made in detail to embodiments of the present disclosure, examples of which are illustrated in the accompanying drawings. Whenever possible, the same reference numerals will be used throughout the drawings to refer to the same or like parts. However, this disclosure can be embodied in many different forms and should not be construed as limited to the embodiments set forth herein.

As used herein, the term "about" means that amounts, sizes, formulations, parameters, and other quantities and characteristics are not and need not be exact, but may be approximate and/or larger or smaller, as desired, reflecting tolerances, conversion factors, rounding off, measurement error and the like, and other factors known to those of skill in the art.

Ranges can be expressed herein as from "about" one particular value, and/or to "about" another particular value. When such a range is expressed, another embodiment includes from the one particular value to the other particular value. Similarly, when values are expressed as approximations by use of the antecedent "about," it will be understood that the particular value forms another embodiment. It will be further understood that the endpoints of each of the ranges are significant both in relation to the other endpoint, and independently of the other endpoint.

Directional terms as used herein—for example, up, down, right, left, front, back, top, bottom—are made only with reference to the figures as drawn and are not intended to imply absolute orientation.

Unless otherwise expressly stated, it is in no way intended that any method set forth herein be construed as requiring that its steps be performed in a specific order, nor that with any apparatus, specific orientations be required. Accordingly, where a method claim does not actually recite an order to be followed by its steps, or that any apparatus claim does not actually recite an order or orientation to individual components, or it is not otherwise specifically stated in the claims or description that the steps are to be limited to a specific order, or that a specific order or orientation to components of an apparatus is not recited, it is in no way intended that an order or orientation be inferred in any respect. This holds for any possible non-express basis for interpretation, including matters of logic with respect to arrangement of steps, operational flow, order of components, or orientation of components; plain meaning derived from grammatical organization or punctuation, and; the number or type of embodiments described in the specification.

As used herein, the singular forms "a," "an," and "the" include plural references unless the context clearly dictates otherwise. Thus, for example, reference to "a" component includes aspects having two or more such components, unless the context clearly indicates otherwise.

The word "exemplary," "example," or various forms thereof are used herein to mean serving as an example, instance, or illustration. Any aspect or design described herein as "exemplary" or as an "example" should not be construed as preferred or advantageous over other aspects or designs. Furthermore, examples are provided solely for purposes of clarity and understanding and are not meant to limit or restrict the disclosed subject matter or relevant portions of this disclosure in any manner. It can be appreciated that a myriad of additional or alternate examples of varying scope could have been presented but have been omitted for purposes of brevity.

As used herein, the terms "comprising" and "including," and variations thereof, shall be construed as synonymous and open-ended, unless otherwise indicated. A list of elements following the transitional phrases comprising or including is a non-exclusive list, such that elements in addition to those specifically recited in the list may also be present.

The terms "substantial," "substantially," and variations thereof as used herein are intended to note that a described feature is equal or approximately equal to a value or description. For example, a "substantially planar" surface is intended to denote a surface that is planar or approximately planar. Moreover, "substantially" is intended to denote that two values are equal or approximately equal. In some embodiments, "substantially" may denote values within about 10% of each other, such as within about 5% of each other, or within about 2% of each other.

As used herein, complementary shapes are shapes with opposing boundaries that fit intimately together, such as by abutment. Examples of complementary shapes include: assembled adjacent puzzle pieces have complementary edges, and; a three-dimensional mold and a part formed therewith have complementary surfaces.

Figure 2:
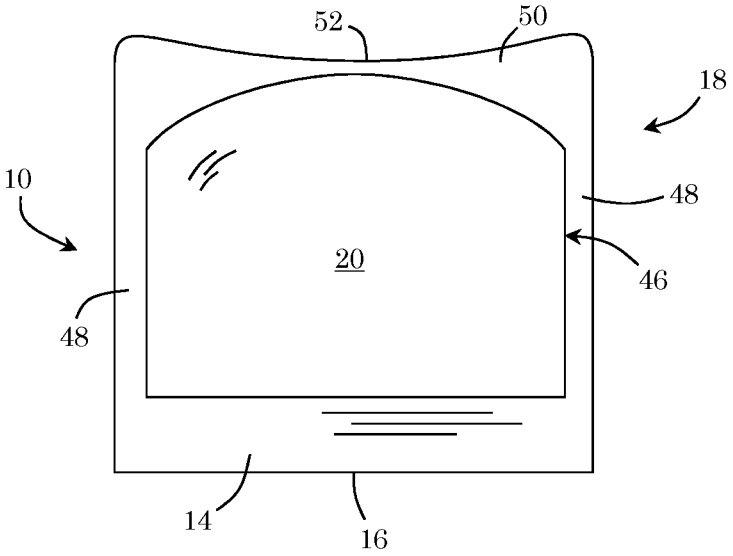
FIG. 2 is a front view of the optical sight of FIG. 1.
Figure 3:
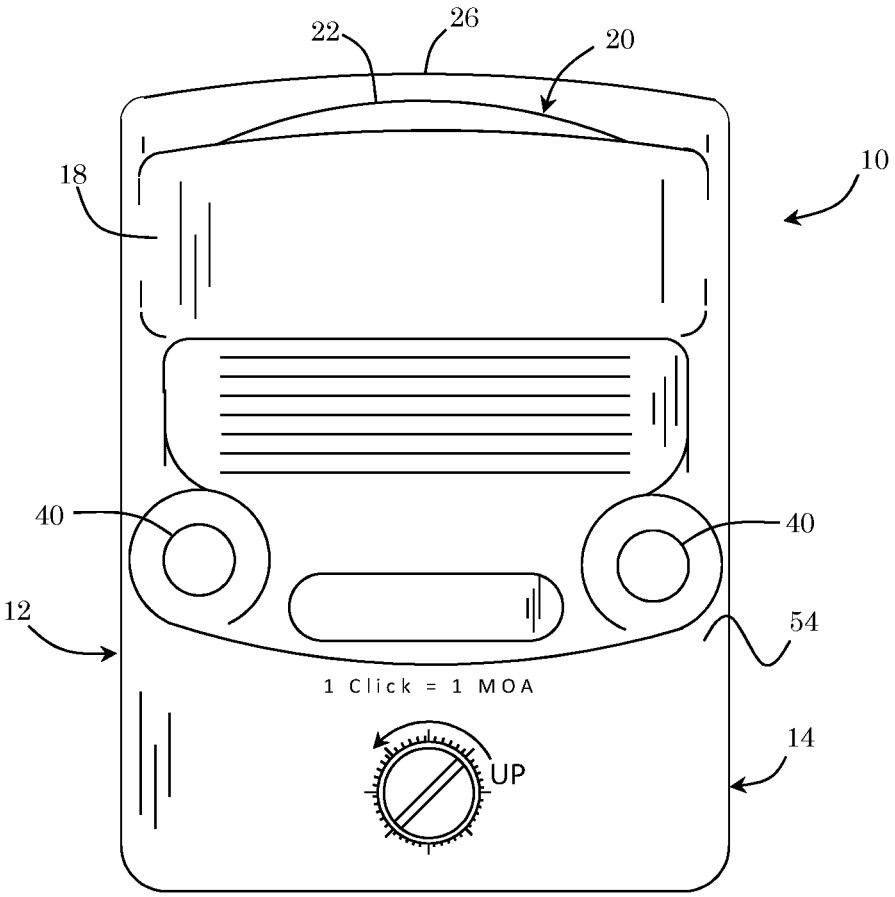
FIG. 3 is a top view of the optical sight of FIGS. 1 and 2.

FIGS. 1-3 depict an exemplary electronic sight (hereinafter "optical sight") 10 comprising housing 12 including base 14 having a bottom mounting surface 16 and a canopy 18 positioned forward on base 14 (optical sight 10 is shown transparent so that internal components can be viewed). Canopy 18 can be integral with base 14. As used herein, integral means individual portions are formed together as a single, monolithic part. For example, in some embodiments, housing 12, including base 14 and canopy 18, can be formed of a polymer (plastic) material, such as a polycarbonate or acrylonitrile butadiene styrene (ABS), for example by injection molding or 3D printing. However, in further embodiments, housing 12 can be machined or cast metal, for example machined or cast aluminum or aluminum alloy. Optical sight 10 further comprises optical element 20 comprising a front surface 22 arranged to face the target and a rear surface 24 arranged to face the shooter. Optical element 20 can be mounted in a generally upright orientation in canopy 18 proximate forward end 26 of housing 12. Optical element 20 can comprise a glass or plastic optical element, or a combination thereof. For example, optical element 20 can comprise a laminated structure, and in various embodiments optical element 20 may be coated with one or more coatings such as vapor-deposited anti-reflection coatings and the like. One or both front and rear surfaces 22, 24 can be aspherical surfaces. Optical element 20 can be fitted into canopy 18 by inserting optical element 20 into a locating groove extending around an inner surface of canopy 18, thereby locating optical element 20 in a predetermined orientation within canopy 18 and securing optical element 20 therein, for example, by an adhesive. However, other methods of mounting optical element 20 in canopy 18 as known in the art may be used.

Base 14 may further comprise an electronics module 28 including circuitry needed to operate light source 30 arranged to direct a beam of light 32 at rear surface 24 and create an illuminated indicium (e., a dot, a circle, a cross, and the like) superimposed on a target image for the shooter to align the handgun with the target (not shown) as viewed through optical element 20. Base 14 may further include a battery compartment 34 to house a battery to power the circuitry and light source 30. Light source 30, e.g., a light emitting diode (LED), can be aligned with the center of the optical axis of surfaces 22, 24 but lie below line of sight 38. The optical axis may also be parallel to line of sight 38. Thus, light source 30 provides an illuminated indicium which can be viewed superimposed on an unobstructed image of the target. This avoids the need to angle the optical axis relative to line of sight 38 to avoid the light source and housing entering and/or masking the viewed image area and resulting in an obstructed image of the target. Base 14 also comprises a through-passage 40 configured to receive threaded fastener 42 (see FIG. 4) and arranged such that threaded fastener 42 can engage with a mounting surface of a firearm and/or an optical sight adapter. In various embodiments, through-passage 40 may not be threaded. Additionally, base 14 may further comprise recess 44, for example two or more recesses 44, configured to receive a registration feature, e.g., a registration pin or pins. Base 14 may include a plurality of recesses configured to receive corresponding registration pins positioned on a surface of the firearm or a surface of an optical sight adapter. While the following description is presented in the context of a handgun, optical sight 10 may be mounted to a variety of firearms using optical sight adapters disclosed herein, or variations thereof, including rifles, shotguns, and revolvers.

FIG. 2 is a front view of optical sight 10 showing canopy 18 defining an opening 46 (e.g., window), wherein optical element 20 extends across the opening. Opening 46 is bounded by side members 48 extending upwardly from base 14, an upper cross-member 50 extending between side members 48, and base 14 opposite cross-member 50. In some embodiments, opening 46 may have a D-shape comprising linear bottom and sides, and an upwardly convex top, although in further embodiments, opening 46 may have other shapes, for example a round or oval, or elliptical shape. An upper surface 52 of cross-member 50 may have a downwardly concave curvature. As such, side members 48 may extend a greater distance above base 14 than cross-member 50, and an impact with the top of optical sight 10 may thereby be transmitted to base 14 rather than optical element 20. However, in further embodiments, upper surface 52 may have an upwardly convex curvature. FIG. 3 is a top view of optical sight 10 and depicts a pair of through-passages 40 extending from a top surface 54 of base 14 to bottom mounting surface 16 for mounting optical sight 10 to a firearm.

Figure 4:
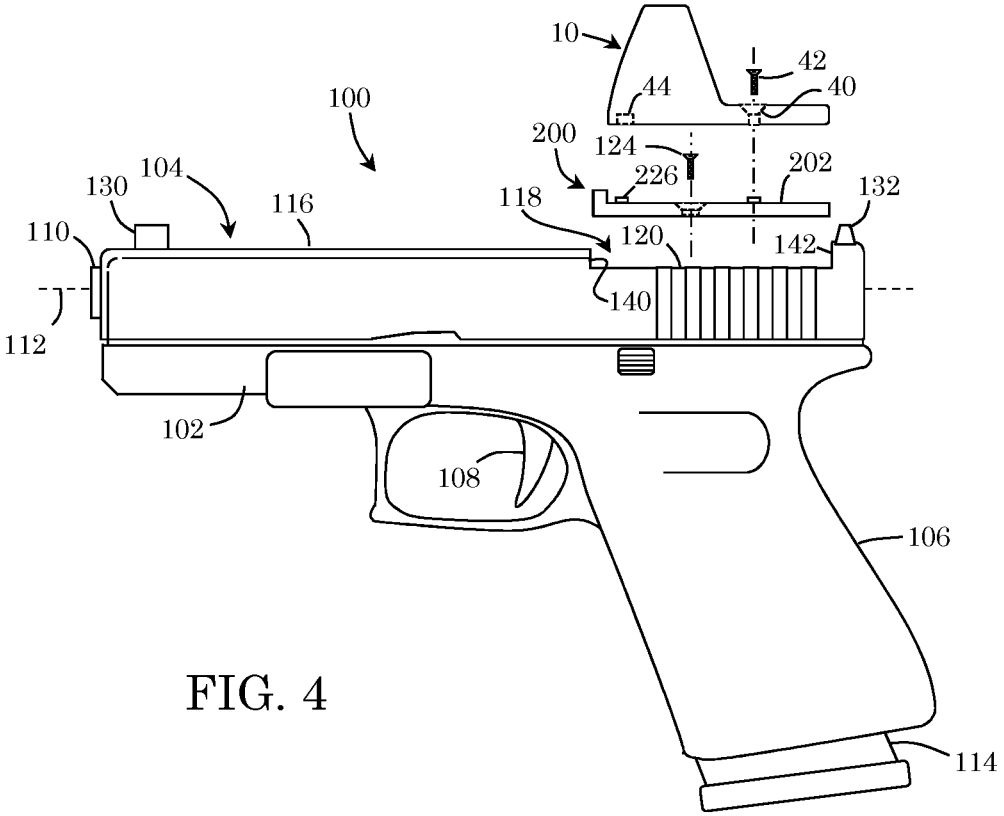
FIG. 4 is a side, partially exploded, schematic view of an exemplary handgun including an optical sight adapter and an optical sight mounted to the handgun slide with the optical sight adapter.
Figure 5:
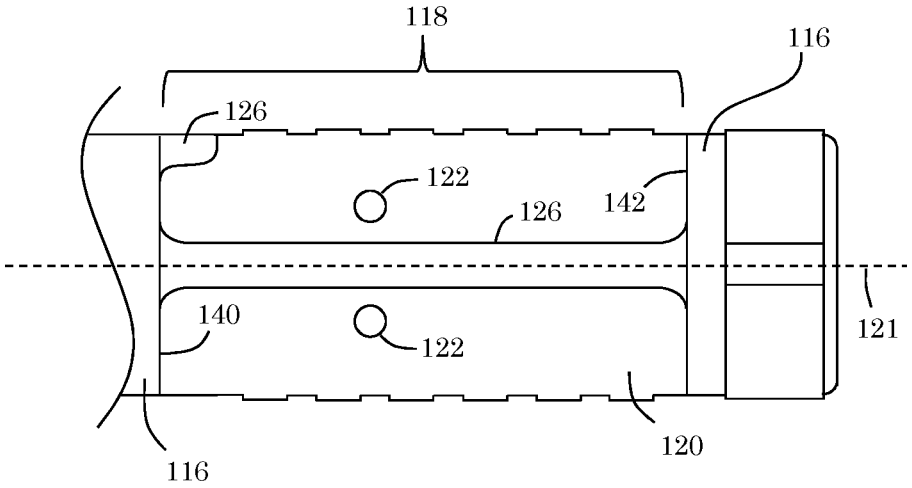
FIG. 5 is a top view of a recessed area of the handgun slide configured to receive an optical sight adapter.

Turning now to FIG. 4, a partially exploded view of an exemplary handgun 100 is shown, handgun 100 comprising a frame 102, a slide 104 slidingly engaged with frame 102, a grip 106, a trigger 108 operatively connected to a trigger assembly (not shown) housed by frame 102, a barrel 110 extending along longitudinal axis 112, barrel 110 housed in a channel in slide 104, and a magazine 114 removably housed in grip 106 and configured to hold ammunition biased by a spring that urges ammunition cartridges toward a feed end of the magazine. Slide 104 comprises an upper surface 116 including a recessed area 118. Recessed area 118 may be machined into upper surface 116, such as by milling. A top view of recessed area 118 is provided in FIG. 5 showing a bottom surface 120 of recessed area 118 defining threaded passages 122 configured to receive and engage with threaded fasteners 124 (see FIG. 4). In some embodiments, bottom surface 120 may include an orientation feature 126 configured to orient, for example, align, a mounted article such as an optical sight or optical sight adapter, and prevent lateral movement of the article. In the illustrated embodiment, orientation feature 126 can comprise a raised ridge of slide material machined proud of bottom surface 120 and extending longitudinally in a length direction, e.g., along longitudinal axis 121 (e.g., parallel with longitudinal axis 112 of barrel 110) of the recessed area and extending upward from bottom surface 120. However, the particular size, shape and orientation of any one or more orientation features can vary depending on handgun manufacturer and handgun design, and the illustration of FIG. 5 is not limiting in this regard. For example, orientation features may take the form of raised (e.g., protruding) features such as but not limited to posts, pins, raised flats, etc., or indents, recesses, or the like. In the embodiment depicted in FIG. 5, bottom surface 120 is shown comprising an additional raised orientation feature 126.

In various embodiments, handgun 100 may further comprise iron sights including front sight 130 and rear sight 132. Front sight 130 may be a blade, a ball, a rod, or any other suitable aiming device. Rear sight 132 may comprise a notch, such as a V-shaped notch, a U-shaped notch, a peep hole, or the like, through which front sight 130 is viewed and aligned by the shooter. In accordance with embodiments described herein, optical sight 10 can be mounted to slide 104 via optical sight adapter 200 coupled to bottom surface 120 of recessed area 118 and extending between forward surface 140 and rear surface 142 of recessed area 118 and described in greater detail herein below. In some embodiments, optical sight 10 can be arranged such that the iron sights can be co-witnessed through optical sight 10 thereby allowing the shooter to continue aiming if the optical sight fails, or to use the iron sights in conjunction with the optical sight indicium.

Figure 8:
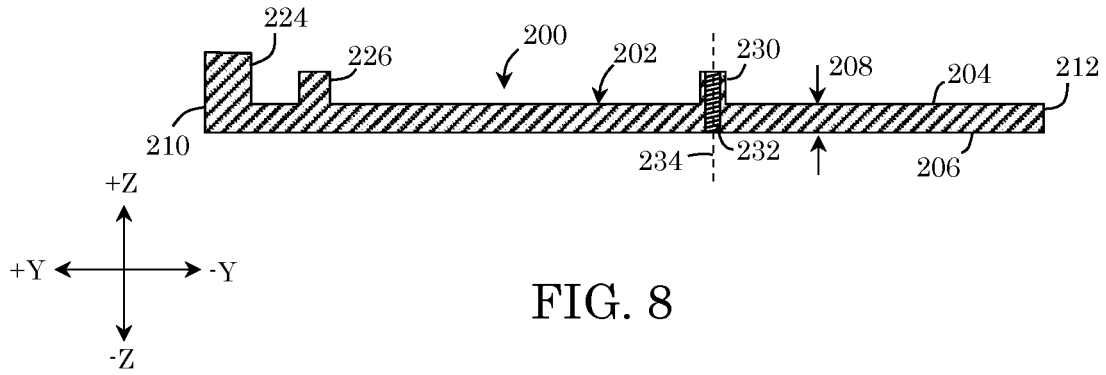
FIG. 8 is a cross-sectional view of the optical sight adapter of FIG. 6 taken along line 8-8 illustrating internally threaded integral mounting posts.

As seen in FIGS. 6-10, optical sight adapter 200 according to some embodiments can comprise a generally rectangular adapter plate 202 comprising a first (upper) mounting surface 204 (FIG. 6), a second (lower) mounting surface 206 (FIG. 7), and a thickness 208 defined between first mounting surface 204 and second mounting surface 206 along a normal to at least one of the first or second mounting surfaces (FIG. 8). In various embodiments, first mounting surface 204 and second mounting surface 206 can be parallel to each other. In various embodiments, first mounting surface 204 and second mounting surface 206 can be generally planar. In some embodiments optical sight adapter 200 can be formed of a polymer (plastic) material, for example by injection molding or 3D printing. However, in further embodiments, optical sight adapter 200 can be metal, for example machined, cast, or 3D-printed metal, such as but not limited to aluminum or an aluminum alloy, or steel.

Optical sight adapter 200 further comprises a forward end 210 and a rear end 212 defining a length 214 therebetween, and a first side edge surface 216 and a second side edge surface 218 defining a width 220 therebetween orthogonal to length 214. Length 214 and width 220 will depend on the design of slide 104 and more particularly the length and width of recessed area 118 and the length and width of optical sight 10, as the optical sight adapter is configured to extend from the forward surface 140 to the rear surface 142 of the particular recess to which the sight adapter is to be mounted. However, by way of example and not limitation, in some embodiments, length 214 can be in a range from about 4 centimeters (cm) to about 6 cm, for example in a range from about 4.2 cm to about 5.5 cm, such as in a range from about 4.5 cm to about 5.2 cm, including all ranges and subranges therebetween, and width 220 can be in a range from about 2.5 cm to about 3 cm, for example in a range from about 2.6 cm to about 2.8 cm, including all ranges and subranges therebetween, although other dimensions as warranted by the handgun design are contemplated. First and second side edge surfaces 216, 218 can, in various embodiments, be flat surfaces and generally extend parallel to one another. In some embodiments, side edge surfaces 216, 218 can be orthogonal to one or both of first mounting surface 204 and second mounting surface 206. However, in further embodiments, side edge surfaces 216, 218 may include channels, raised areas, or other gripping features used to manipulate slide 104. Such gripping features may correspond to similar gripping features located on slide 104. A proper grip on handgun 100 by a shooter, for example a two-handed grip, may place the shooter's thumbs alongside the slide, wherein sharp edges on adapter plate 202 may cause injury to the shooter as the slide reciprocates during discharge of the handgun. Accordingly, in some embodiments, at least one of first side edge surface 216 or second side edge surface 218 may comprise a chamfer 222 (see FIG. 9). In some embodiments, chamfer 222 may connect with second mounting surface 206 but not first mounting surface 204. That is, only a portion of first side edge surface 216 and/or second side edge surface 218 may be chamfered, such as a bottom portion of each side edge, although in further embodiments, a top portion of each side edge may be chamfered. In addition, chamfer 222 can provide a transition from a width of slide recessed area 118 to a width of optical sight 10. That is, in some embodiments, a width of optical sight 10 (in a direction orthogonal to longitudinal axis 112) may be greater than width 220 of recessed area 118. Thus, chamfer 222 can provide both a functional and an aesthetic transition from the width of recessed area 118 to the width of optical sight 10.

Optical sight adapter 200 may further comprise an integral recoil buffer 224 positioned at forward end 210 and extending upright (in the +Z direction, see FIG. 8) from first mounting surface 204. For example, in some embodiments, recoil buffer 224 may extend orthogonally from first mounting surface 204. Recoil buffer 224 can provide forward support to optical sight 10 during recoil of slide 104. The term "forward", when used in connection with any of the optical sight adapters disclosed herein, refers to a direction from rear end 212 toward forward end 210, e.g., along arrow 211, or positioned closer to forward end 210 than rear end 212. In embodiments, rear-facing support surface 225 may have a shape complementary to forward end 26 of optical sight 10 so that when optical sight 10 is mounted on optical sight adapter 200, contact between forward end 26 of optical sight 10 and support surface 225 can be maximized. A width 227 of recoil buffer 224 can be at least 0.5 times width 220, for example at least about 0.75 times width 220. In some embodiments, width 227 of recoil buffer 224 can be equal to width 220.

First mounting surface 204 can be configured to engage with bottom mounting surface 16 of optical sight 10, while second mounting surface 206 is configured to engage with bottom surface 120 of recessed area 118. Accordingly, optical sight adapter 200, and in particular, adapter plate 202, can function as a mating interface between slide 104 and optical sight 10. In various embodiments, thickness 208 of adapter plate 202 can be in a range from about 2 mm to about 4 mm, for example in a range from about 2.0 mm to about 3.5 mm, such as in a range from about 2.0 mm to about 3.0 mm, in a range from about 2.0 mm to about 2.5 mm, in a range from about 2.0 mm to about 2.4 mm, in a range from about 2.0 mm to about 2.2 mm, in a range from about 2.3 mm to about 4.0 mm, in a range from about 2.5 mm to about 4.0 mm, in a range from about 2.7 to about 4.0 mm, or in a range from about 3.0 mm to about 4.0 mm, including all ranges and subranges therebetween.

Figure 6:
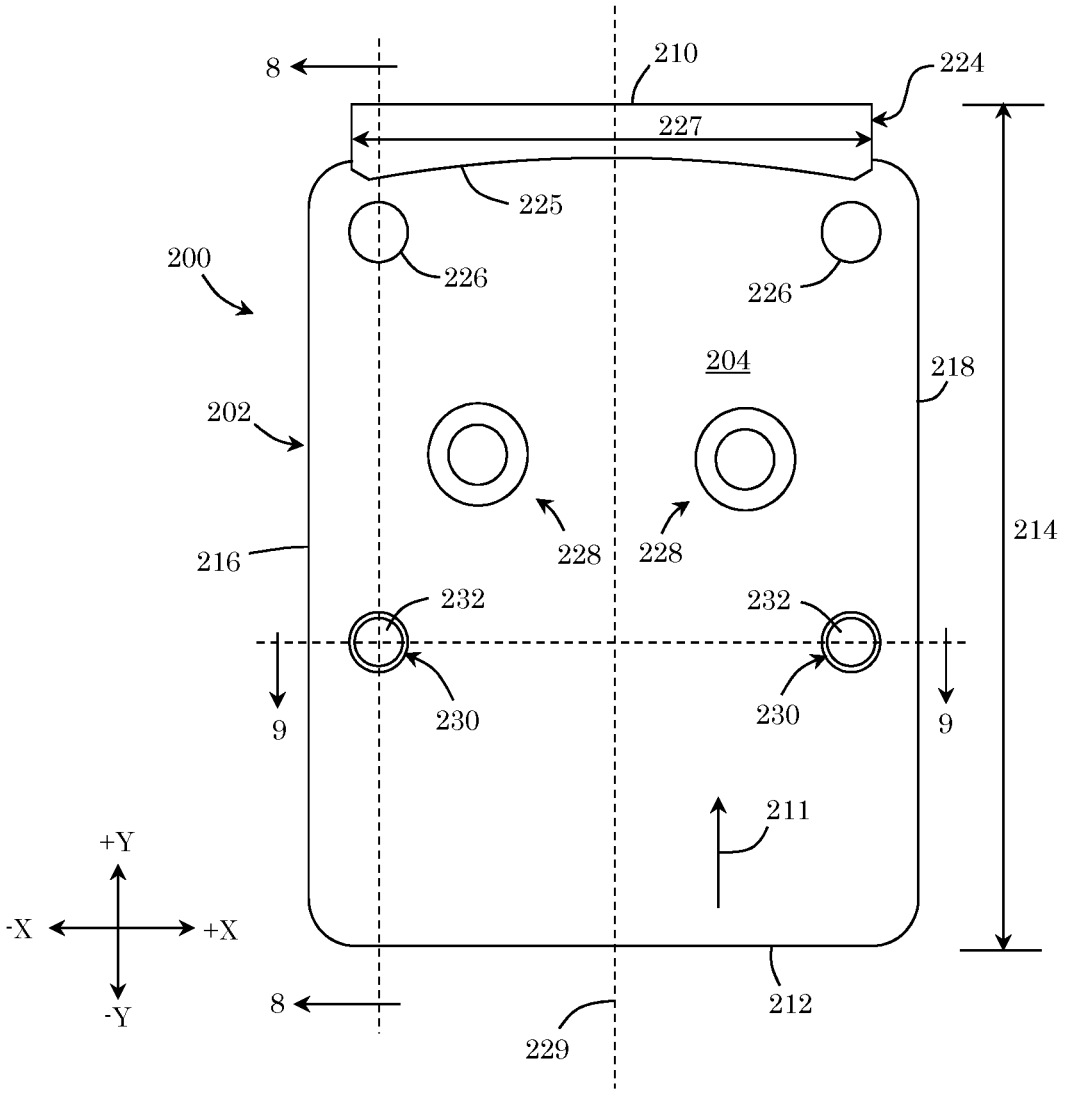
FIG. 6 is a schematic view of an exemplary optical sight adapter according to an embodiment of the present disclosure and showing an upper mounting surface of the optical sight adapter.
Figure 7:
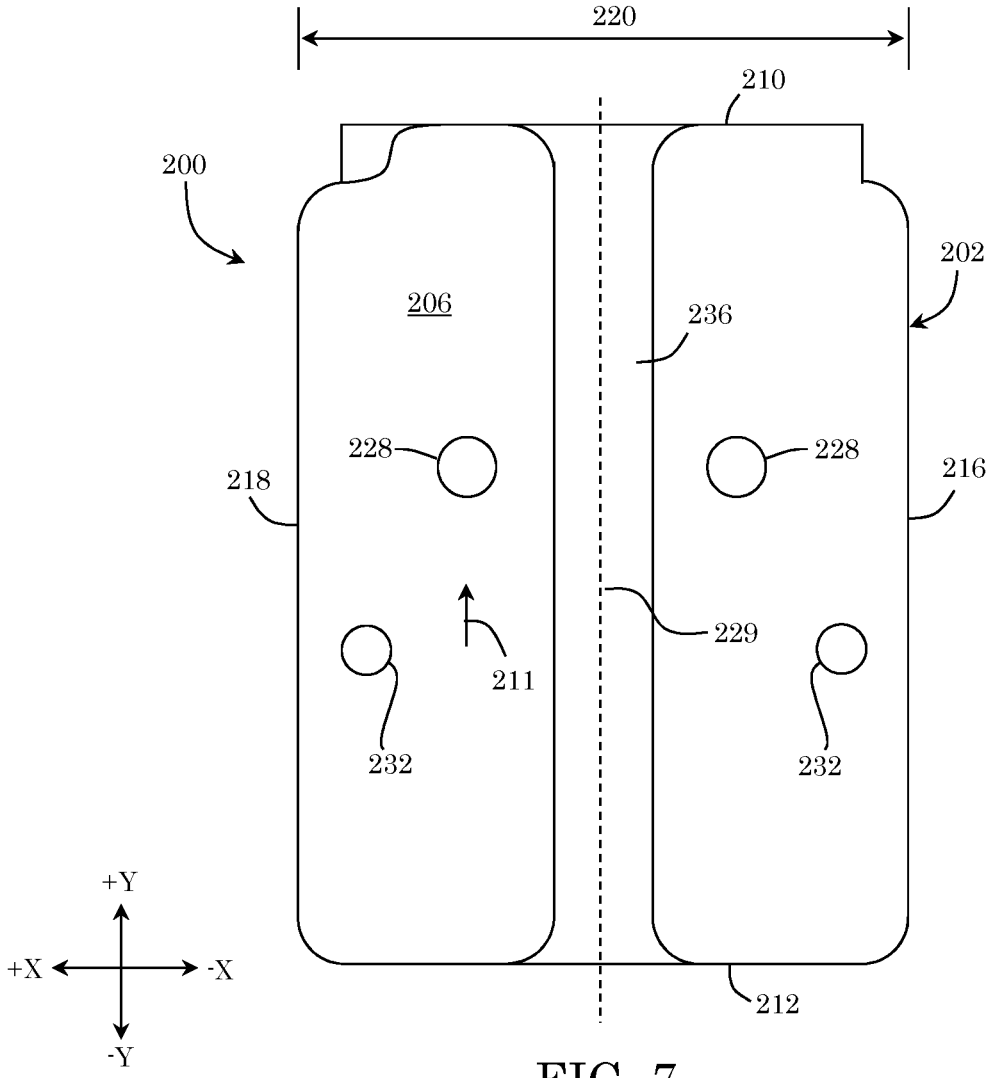
FIG. 7 is a schematic view of the lower mounting surface of the optical sight adapter of FIG. 6.

First mounting surface 204 may further comprise one or more registration pins 226 extending upward (in the +Z direction), for example orthogonally, from first mounting surface 204. Registration pins 226 may, for example, be located at the forward half of adapter plate 202, such as proximate recoil buffer 224. As shown in FIG. 8, registration pins 226 can be solid (e.g., include no hollow areas). As illustrated in FIG. 6, first mounting surface 204 may include a pair of registration pins 226, each registration pin of the pair of registration pins positioned on an opposite side of a central longitudinal axis 229 from the other registration pin, longitudinal axis 229 extending along a length of and bisecting the adapter plate. Additionally, adapter plate 202 may include one or more apertures 228 extending through thickness 208 of adapter plate 202 between first mounting surface 204 and second mounting surface 206, such as a pair of apertures 228, for mounting optical sight adapter 200 to bottom surface 120 of recessed area 118 via threaded fasteners 124. Apertures 228 may comprise a chamfered upper surface connecting to first mounting surface 204. That is, the one or more apertures 228 can be countersunk to receive a fastener head, e.g., screw head. The chamfer can be any size or shape suitable to ensure the fastener head is at or below first mounting surface 204 when the fastener is tightened and engaged in the aperture. Similar to registration pins 226, apertures 228 can be positioned on opposite sides of longitudinal axis 229, although apertures 228 may be positioned anywhere on adapter plate 202. Threaded fasteners 124 can be inserted through apertures 228 and engaged with threaded passages 122, thereby coupling optical sight adapter 200 to handgun 100. Accordingly, the unchamfered portions of apertures 228 can be of uniform diameter.

Figure 9:
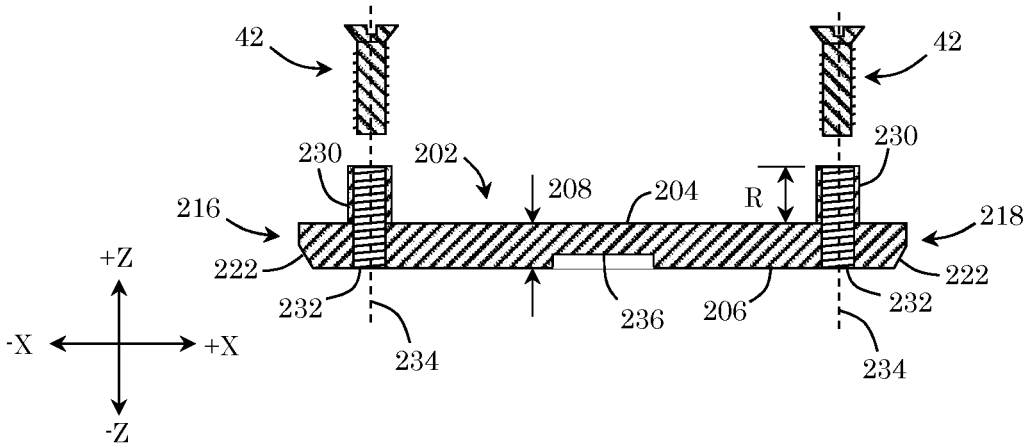
FIG. 9 is a cross sectional end view of the optical sight adapter of FIG. 6 taken along line 9-9 and illustrating the internally threaded integral mounting posts.

As best seen in FIG. 8 showing a side cross-sectional view of optical sight adapter 200, adapter plate 202 may further comprise one or more integral mounting posts 230 extending upward (in the +Z direction) from first mounting surface 204, for example orthogonal to first mounting surface 204, a distance R above first mounting surface 204 (see FIG. 9). In some embodiments, R can be equal to or greater than about 1 millimeter (mm), for example in a range from about 1 mm to about 3.5 mm, such as in a range from about 1.2 mm to about 3 mm, for example in a range from about 1.5 mm to about 2.7 mm, or in a range from about 2 mm to about 2.7 mm, including all ranges and subranges therebetween. As depicted in FIG. 9, adapter plate 202 can comprise two integral mounting posts 230 positioned on opposite sides of longitudinal axis 229, although more than two mounting posts 230 are contemplated in further embodiments, such as three mounting posts 230 or four mounting posts 230.

Figure 10:
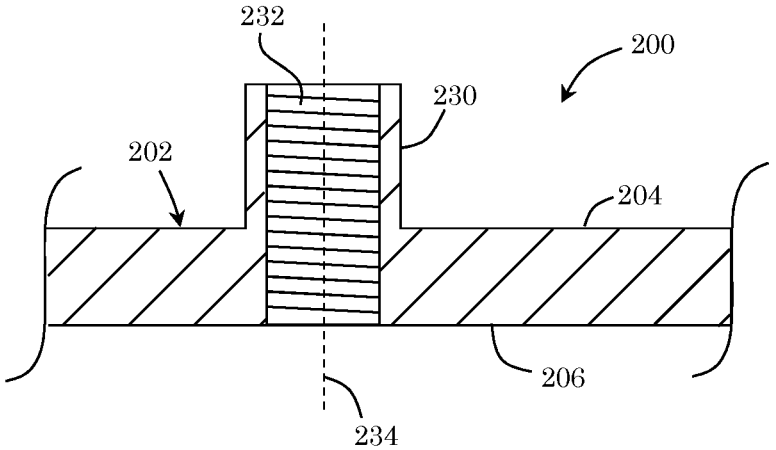
FIG. 10 is a close-up view of an internally threaded integral mounting post.

Mounting posts 230 may, in some embodiments, be positioned such that apertures 228 are positioned between mounting posts 230 and registration pins 226. For example, within a rear half of adapter plate 202. However, registration pins 226, apertures 228, and mounting posts 230 can be positioned in any suitable location on first mounting surface 204. As best seen in FIG. 10, each mounting post 230 can be hollow, defining a threaded passage 232 extending along a longitudinal axis 234 of the mounting post. In some embodiments, threaded passage 232 can extend entirely through mounting post 230 and adapter plate 202. The one or more mounting posts 230 can be sized to fit within a respective through-passage 40 of optical sight 10, extending upward into the through-passage, wherein threaded fastener 42 can be used to couple optical sight 10 to optical sight adapter 200. That is, threaded fastener 42 can be inserted into through-passage 40 and engaged with mounting post 230 via threaded passage 232, thereby providing coupling of optical sight 10 to optical sight adapter 200. Mounting posts 230 can provide an extended thread engagement compared to a threaded aperture extending through a thin adapter plate only. That is, mounting post 230 extends above first mounting surface 204 and can provide greater thread count for a threaded fastener to engage with than adapter plates that offer threaded apertures that extend only through a thickness of the adapter plate itself, thereby increasing a strength of the engagement. Additionally, because the one or more mounting posts 230 are configured to extend into a respective through-passage 40 of optical sight 10, optical sight 10 may be able to more robustly withstand shock associated with slide recoil without the optical sight shifting position. FIG. 10 is a close-up cross-sectional view showing mounting post 230 and threaded passage 232 extending along longitudinal axis 234. FIG. 10 shows the threads of threaded passage 232 extending within the threaded passage 232 above first mounting surface 204.

To mount optical sight 10 to slide 104, optical sight adapter 200 is first secured within recessed area 118 by inserting optical sight adapter 200 into recessed area 118 so that second mounting surface 206 of optical sight adapter 200 contacts bottom surface 120 of recessed area 118. If recessed area 118 comprises an orientation feature, such as orientation feature 126, for example a raised ridge or a recess, a complementary feature on second mounting surface 206, such as recessed channel 236 or a raised feature located in second mounting surface 206, can be engaged with the orientation feature of bottom surface 120 of recessed area 118. With optical sight adapter 200 in place in recessed area 118, optical sight adapter 200 can be coupled to slide 104 by inserting threaded fasteners 124 through apertures 228 and into engagement with threaded passages 122. The threaded fasteners may thereafter be tightened by rotating the threaded fastener with an appropriate tool.

Once optical sight adapter 200 is coupled to slide 104, optical sight 10 can be positioned on optical sight adapter 200 so registration pins 226 are received into recesses 44, mounting posts 230 are received into through-passages 40 from bottom mounting surface 16 of optical sight 10, and threaded fasteners 42 are inserted into through-passages 40 and engaged with mounting posts 230 via threaded passages 232. The threaded fasteners 42 are then tightened to secure optical sight 10 to optical sight adapter 200.

Figure 11:
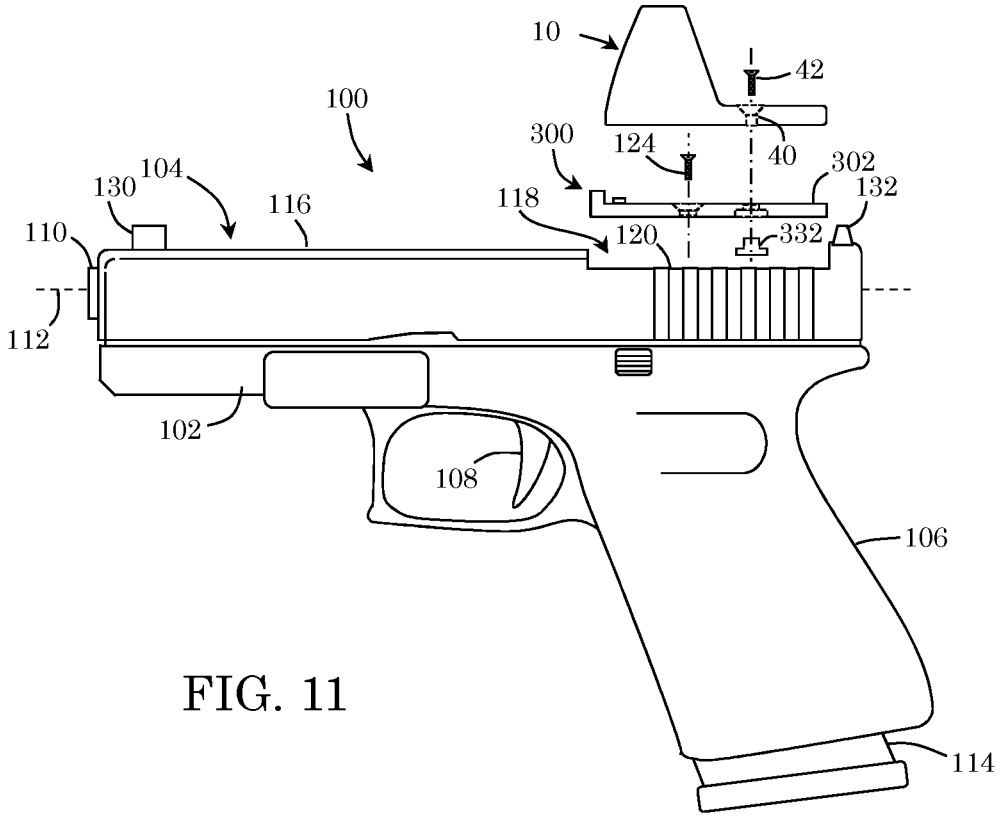
FIG. 11 is a side, partially exploded, schematic view of an exemplary handgun including another embodiment of an optical sight adapter and an optical sight mounted to the handgun with the optical sight adapter.

Turning now to FIG. 11, another embodiment of handgun 100 is shown, including an exemplary optical sight adapter 300 for mounting optical sight 10 to handgun 100. As seen in FIGS. 12-18, optical sight adapter 300 can comprise a generally rectangular adapter plate 302 comprising a first (upper) mounting surface 304 (FIG. 12), a second (lower) mounting surface 306 (FIG. 14), and a thickness 308 defined between first mounting surface 304 and second mounting surface 306 along a normal to at least one of the first or second mounting surfaces (see FIG. 13). In various embodiments, first mounting surface 304 and second mounting surface 306 can be parallel to each other. Thickness 308 of adapter plate 302 can be in a range from about 2 mm to about 4 mm, for example in a range from about 2.0 mm to about 3.5 mm, such as in a range from about 2.0 mm to about 3.0 mm, in a range from about 2.0 mm to about 2.5 mm, in a range from about 2.0 mm to about 2.4 mm, in a range from about 2.0 mm to about 2.2 mm, in a range from about 2.3 mm to about 4.0 mm, in a range from about 2.5 mm to about 4.0 mm, in a range from about 2.7 to about 4.0 mm, or in a range from about 3.0 mm to about 4.0 mm, including all ranges and subranges therebetween. In various embodiments, first mounting surface 304 and second mounting surface 306 can be generally planar. Optical sight adapter 300 can be formed of a polymer (plastic) material, such as a polycarbonate or acrylonitrile butadiene styrene (ABS), for example by injection molding or 3D printing. However, in further embodiments, adapter plate 302 can be metal, for example machined, cast, or 3D-printed metal, such as but not limited to aluminum or an aluminum alloy, or steel.

Optical sight adapter 300 further comprises a forward end 310 and a rear end 312 defining a length 314 therebetween, and side edge surfaces 316 and 318 defining a width 320 therebetween orthogonal to length 314. Length 314 and width 320 will depend on the design of slide 104 and more particularly the length and width of recessed area 118 and the length and width of optical sight 10. However, in some embodiments, length 314 can be in a range from about 4 cm to about 6 cm, for example in a range from about 4.2 cm to about 5.5 cm, such as in a range from about 4.5 cm to about 5.2 cm, including all ranges and subranges therebetween, and width 320 can be in a range from about 2.5 cm to about 3 cm, for example in a range from about 2.6 cm to about 2.8 cm, including all ranges and subranges therebetween. Side edge surfaces 316, 318 can, in various embodiments, be flat surfaces and extend generally parallel to one another. However, in further embodiments, side edge surfaces 316, 318 may include channels, raised areas, or other gripping features used to manipulate slide 104. Such gripping features may correspond to similar gripping features located on slide 104. As described in respect of adapter plate 202, sharp edges on adapter plate 302 may cause injury to the shooter as the slide reciprocates during discharge of the handgun. Accordingly, in some embodiments, at least one of first side edge surface 316 or second side edge surface 318 may comprise a chamfer 322 (see FIG. 15). Chamfer 322 may connect with second mounting surface 306 but not first mounting surface 304, although in further embodiments, chamfer 322 may connect to both the first mounting surface and the second mounting surface. That is, only a portion of first side edge surface 316 and/or second side edge surface 318 may be chamfered, such as a bottom portion of each side edge. In addition, chamfer 322 can provide a transition from a width of recessed area 118 to a width of optical sight 10. That is, in some embodiments, a width of optical sight 10 (in a direction orthogonal to longitudinal axis 112) may be greater than a width of recessed area 118. Thus, chamfer 322 can provide both a functional and an aesthetic transition from the width of the recessed area to the width of the optical sight.

Optical sight adapter 300 further comprises an integral recoil buffer 324 positioned at forward end 310 and extending upright (upward in the +Z direction) from first mounting surface 304. Recoil buffer 324 can space optical sight 10 from forward surface 140 and provide forward support to the optical sight during recoil of slide 104. That is, in instances where optical sight 10 is shorter than recessed area 118, recoil buffer 324 can fill the space between a forward end of optical sight 10 and forward surface 140 of recessed area 118, thereby providing support to optical sight 10 during recoil of slide 104. Accordingly, rear-facing support surface 326 may have a shape complementary to forward end 26 of optical sight 10 so that when optical sight 10 is mounted on optical sight adapter 300, supporting contact between forward end 26 of optical sight 10 and support surface 326 can be maximized. A width 327 of recoil buffer 324 can be at least 0.5 times width 320, for example at least about 0.75 times width 320. In some embodiments, width 327 of recoil buffer 324 can be equal to width 320.

Figure 12:
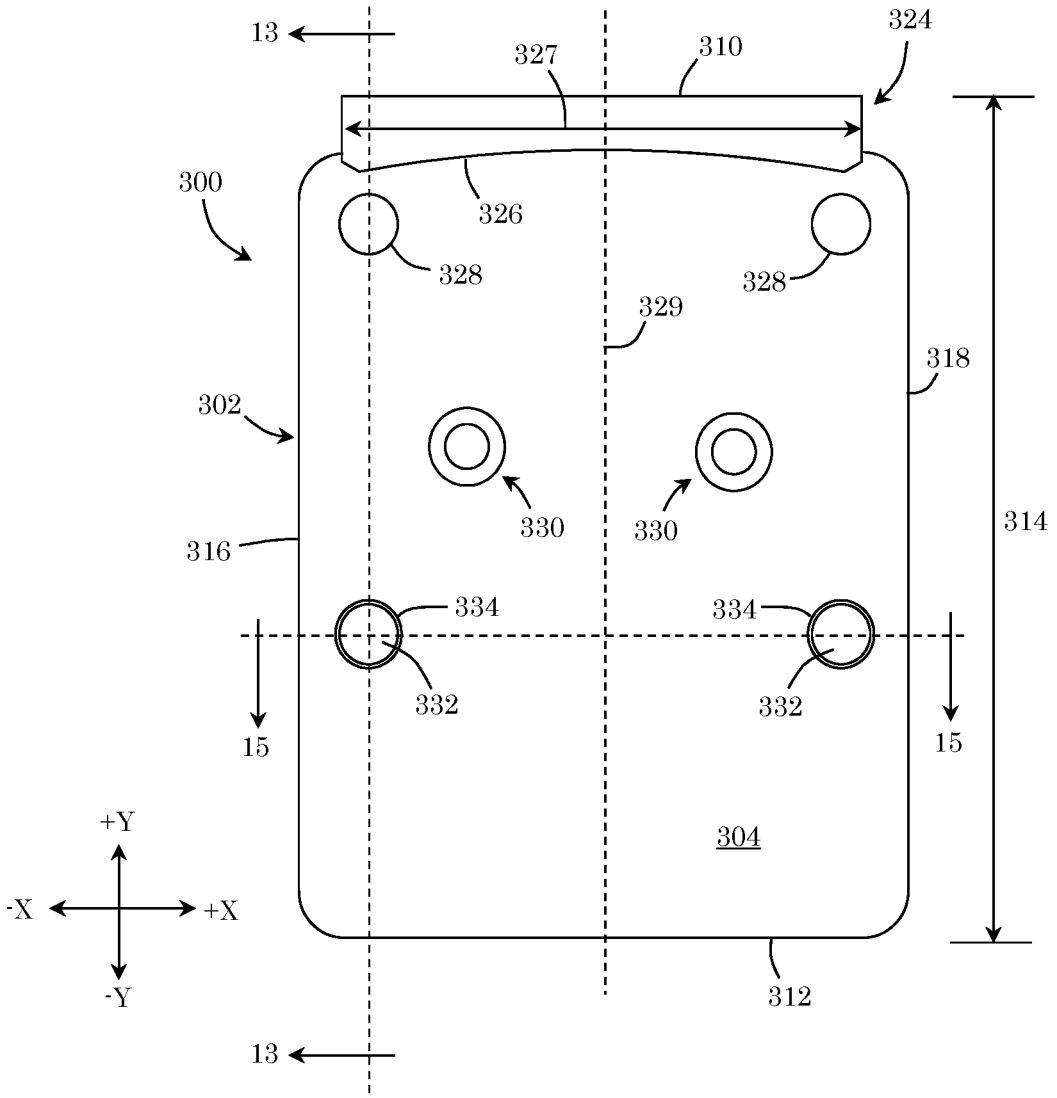
FIG. 12 is a schematic view of an upper mounting surface of the optical sight adapter of FIG. 11.
Figure 13:
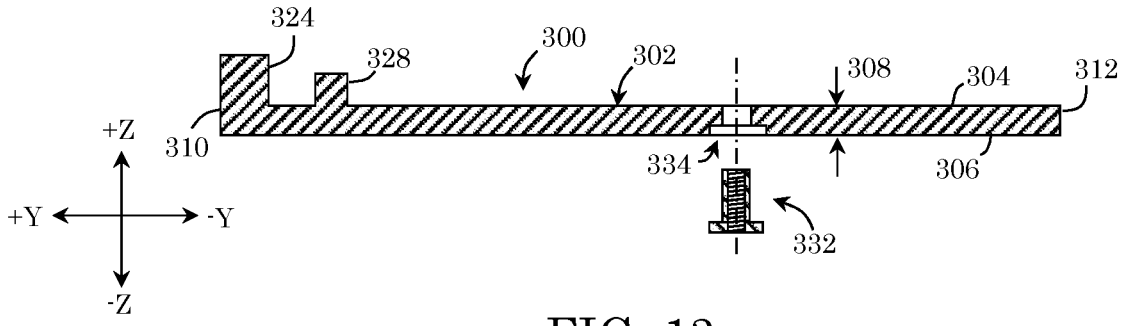
FIG. 13 is a cross-sectional view of the optical sight adapter of FIG. 12 taken along line 13-13 illustrating apertures configured to receive removable mounting posts.

First mounting surface 304 can be configured to engage with bottom mounting surface 16 of optical sight 10, while second mounting surface 306 can be configured to engage with bottom surface 120 of recessed area 118. Accordingly, optical sight adapter 300, and in particular, adapter plate 302, can function as a mating interface between slide 104 and optical sight 10. For example, first mounting surface 304 may comprise one or more registration pins 328 extending upward (in the +Z direction), for example orthogonally, from first mounting surface 304. Registration pins 328 can be solid registration pins. Registration pins 328 can be sized and configured to be received within recesses 44 of optical sight 10. Registration pins 328 can be integral with adapter plate 302. As illustrated in FIG. 12, first mounting surface 304 may include a pair of registration pins 328, each registration pin of the pair of registration pins positioned on an opposite side of a central longitudinal axis 329 from the other registration pin, longitudinal axis 329 extending along a length of and bisecting the adapter plate. However, registration pins 328 can be positioned at any suitable location on first mounting surface 304 as necessitated by the optical sight to be mounted. Additionally, adapter plate 302 may include one or more apertures 330 extending through the thickness of adapter plate 302 from first mounting surface 304 to second mounting surface 306, such as a pair of apertures 330, for coupling optical sight adapter 300 to recessed area 118 via threaded fasteners 124. Apertures 330 may comprise a chamfered upper surface connecting to first mounting surface 304. That is, the one or more apertures 330 may be countersunk to receive a fastener head, e.g., screw head. The chamfer can be any size or shape suitable to ensure the fastener head is at or below first mounting surface 304 when the fastener is tightened and engaged in the aperture 330. Similar to registration pins 328, apertures 330 can be positioned on opposite sides of longitudinal axis 329.

Figure 14:
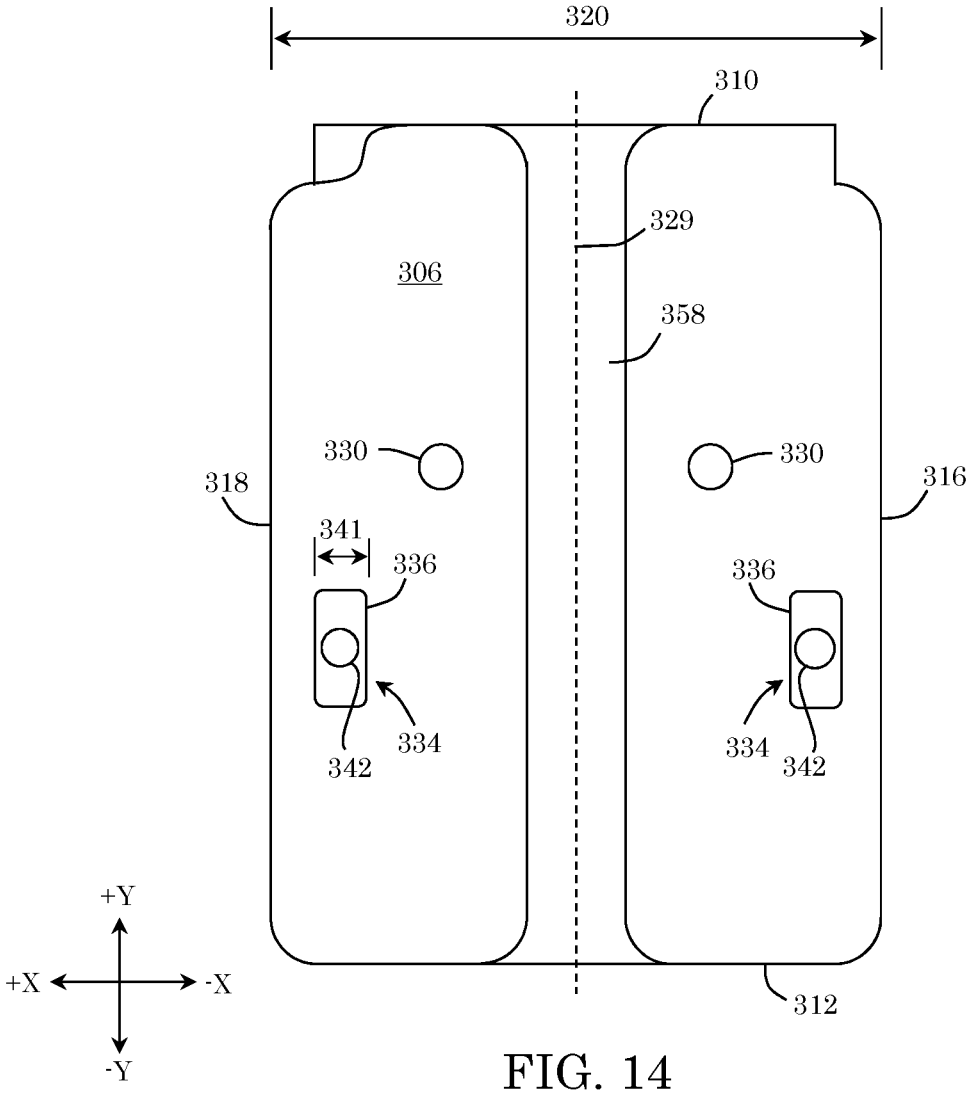
FIG. 14 is a schematic view of a lower mounting surface of the optical sight adapter of FIG. 11.
Figure 15:
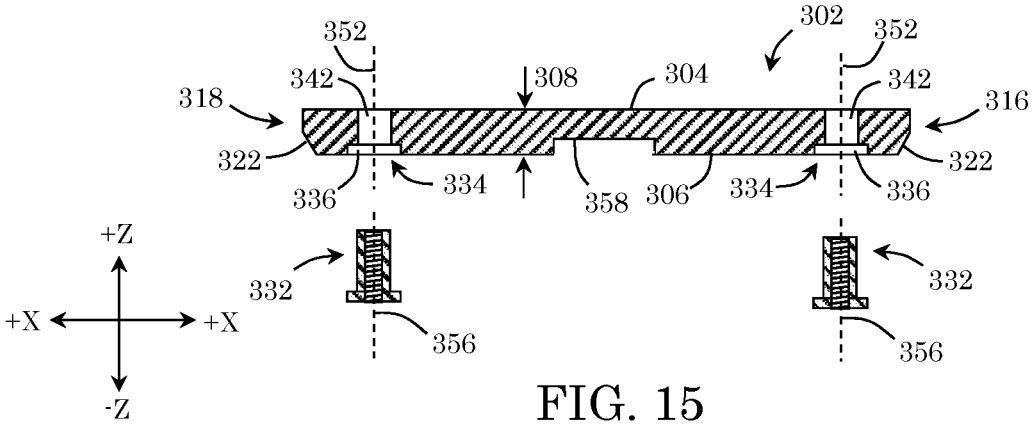
FIG. 15 is a cross-sectional view of the optical sight adapter of FIG. 12 taken along line 15-15 illustrating sockets and removable mounting posts.
Figure 16A:
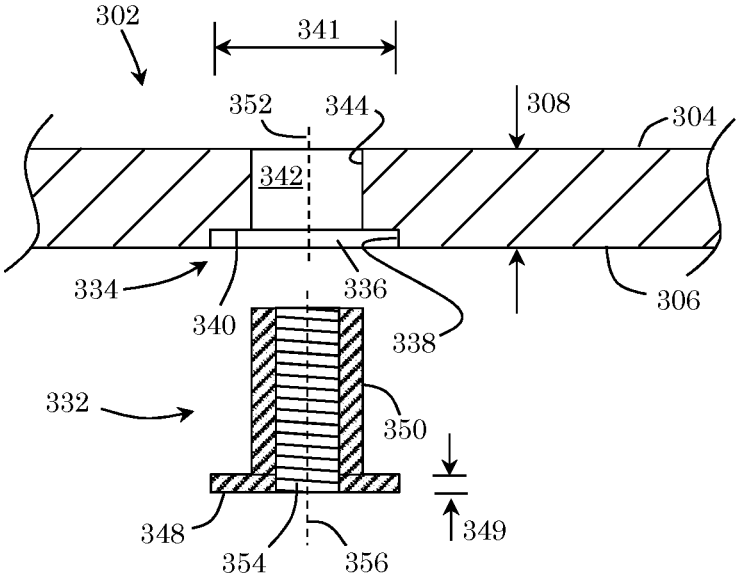
FIG. 16A is a close-up exploded view of a socket and removable mounting post of FIG. 15.
Figure 16B:
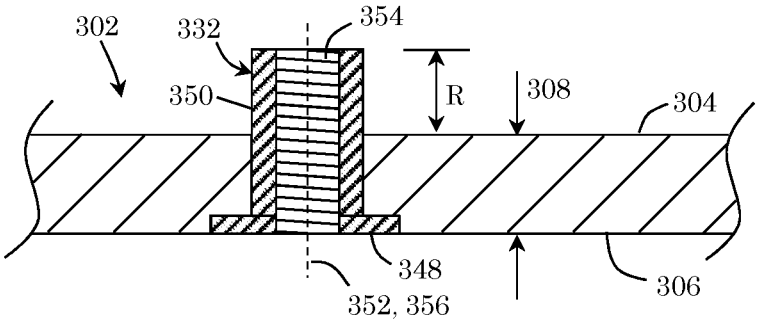
FIG. 16B is a close-up view of the socket and removable mounting post of FIG. 16A showing the removable mounting post inserted in the socket.

Referring to FIGS. 16A and 16B, in various embodiments, adapter plate 302 may further comprise one or more mounting posts 332 configured to removably engage in sockets 334 in second mounting surface 306, sockets 334 extending between second mounting surface 306 and first mounting surface 304. By removably engage what is meant is that mounting posts 332 can be friction-fit (e.g., an interference fit) within sockets 334 such that when mounting posts 332 are engaged in sockets 334, the mounting posts will not drop from the sockets under their own weight when second mounting surface 306 is horizontal and facing down, but can be removed without damaging adapter plate 302 by applying an axial force against a top of a mounting post extending above first mounting surface 304. When engaged with socket 334, mounting post 332 extends distance R above first mounting surface 304, wherein R can be equal to or greater than about 1 mm, for example in a range from about 1 mm to about 3.5 mm, such as in a range from about 1.2 mm to about 3 mm, for example in a range from about 1.5 mm to about 2.7 mm, or in a range from about 2 mm to about 2.7 mm, including all ranges and subranges therebetween. As shown in FIG. 14, adapter plate 302 may comprise a pair of sockets 334 positioned on opposite sides of longitudinal axis 329. However, sockets 334 can be positioned at any suitable location on adapter plate 302 as necessitated by the optical sight to be mounted.

Referring to FIG. 16A, each of the one or more sockets 334 can comprise a recess 336 in second mounting surface 306, recess 336 defined by side wall 338 and bottom wall 340, bottom wall 340 positioned intermediate first mounting surface 304 and second mounting surface 306. Bottom wall 340 may be parallel with first and/or second mounting surface 304, 306. FIG. 16A is a close-up cross-sectional view of socket 334 and mounting post 332 disengaged from socket 334. FIG. 16B is a close-up cross-sectional view of socket 334 shown in FIG. 16A with mounting post 332 engaged with socket 334. Each of the one or more sockets 334 may further comprise an aperture 342, for example a cylindrical aperture, extending from the bottom wall 340 through first mounting surface 304, aperture 342 defined by side surface 344. In embodiments, side surface 344 can be smooth. To wit, in some embodiments, side surface 344 of aperture 342 may not be threaded. In various embodiments, a minimum lateral dimension 341 of recess 336 can be larger than a diameter of aperture 342.

Recess 336 may have a variety of possible peripheral geometric shapes. For example, recess 336 may have a generally rectangular shape as shown in FIG. 14. Corners of the shape may be radiused. However, in further embodiments, recess 336 can have a star-shaped peripheral shape, an elliptical peripheral shape, a triangular peripheral shape, a pentagonal peripheral shape, and the like. In some embodiments, recess 336 can have a circular geometric shape as described farther below. Recess 336 may not be circularly symmetric with reference to longitudinal axis 352 centrally located through aperture 342. That is, recess 336 may be circularly asymmetric with reference to longitudinal axis 352. As used herein, circularly symmetric means that for a line segment extending from and orthogonal to longitudinal axis 352 and terminating at side wall 338, as the line segment is rotated about longitudinal axis 352 a length of the line segment does not vary. Accordingly, circularly asymmetric means that for a line segment extending from and orthogonal to longitudinal axis 352 and terminating at side wall 338, as the line segment is rotated about longitudinal axis 352 a length of the line segment varies. It should be noted that a circular recess 336 with a center positioned such that longitudinal axis 352 passes through the center is circularly symmetric. However, if the center of the circle is offset from longitudinal axis 352 such that recess 336 is positioned eccentrically relative to longitudinal axis 352, the recess would be circularly asymmetric. Accordingly, in some embodiments, recess 336 may be circular if the recess is arranged eccentrically relative to longitudinal axis 352. That is, such that the circular recess is not concentric with aperture 342.

Figure 17:
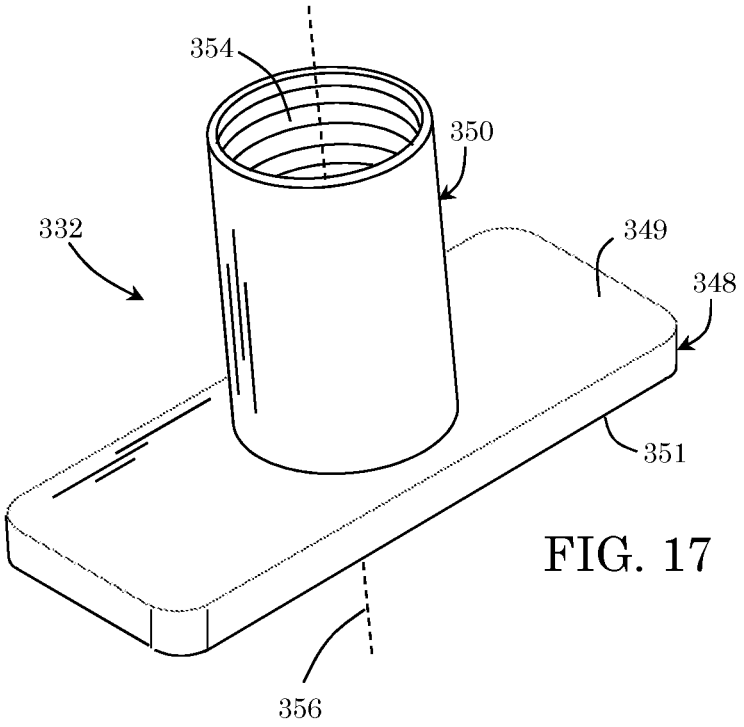
FIG. 17 is a perspective view of an exemplary removable mounting post comprising a generally rectangular flange in according to embodiments of the present disclosure.
Figure 18:
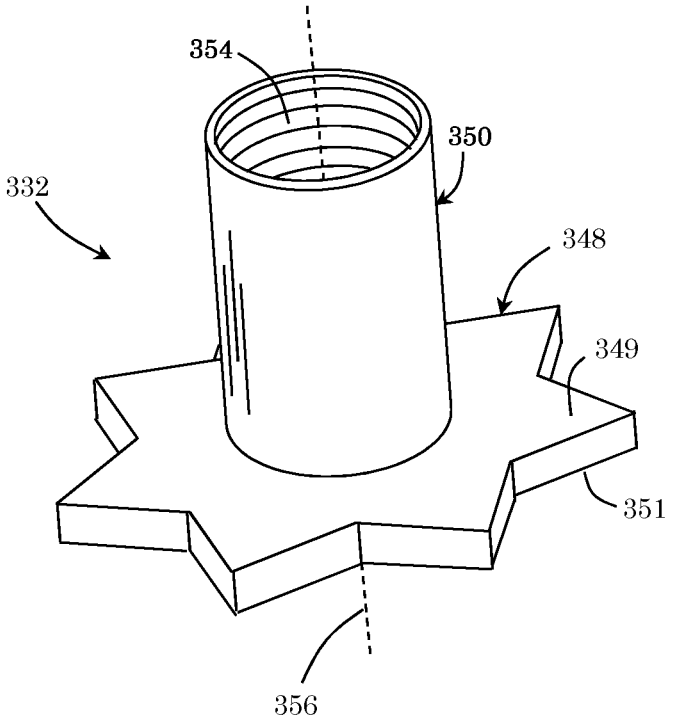
FIG. 18 is a perspective view of another exemplary removable mounting post comprising a star flange according to embodiments of the present disclosure.

As described above, mounting post 332 can be removably engaged with socket 334, wherein mounting post 332 provides a friction fit with socket 334. Mounting post 332 can comprise a flange 348 and a shaft 350 extending from the flange. A shape of flange 348 can be complementary to the shape of recess 336. That is, flange 348 can have the same geometric shape as recess 336 and be sized to provide a friction fit within recess 336. In other words, where recess 336 comprises a generally rectangular shape, mounting post 332 may also comprise a flange 348 with a generally rectangular shape, as shown in FIG. 17, the flange sized to provide a friction fit within recess 336 such that mounting post 332 is retained in socket 334. However, like recess 336, flange 348 may have other geometric shapes that match the geometric shape of recess 336, such as, by way of example and not limitation, a star shape as shown in FIG. 18. Other shapes for flange 348 can include triangular, polygonal (e.g., pentagonal), elliptical, ovoid, or even circular under conditions described above. In some embodiments, major surfaces 349 and 351 of flange 348 may be planar, without protrusions. In addition, shaft 350 can have a geometric cross-sectional shape and/or size (e.g., outer diameter) that is about the same as the interior geometric shape of aperture 342. For example, if aperture 342 comprises a cylindrical shape with a circular cross-section orthogonal to longitudinal axis 352 of aperture 342, shaft 350 can also have a circular cross-sectional shape. According to some embodiments, shaft 350 may have a smooth exterior surface without protrusions. In some embodiments, an outside cross-sectional dimension of shaft 350 may be sized to provide a friction fit with side surface 344 of aperture 342, although such friction fit may not be necessary if flange 348 provides a sufficient friction fit with recess 336. In some embodiments, it may be sufficient to provide a friction fit between shaft 350 and aperture 342 and not between flange 348 and recess 336, while in still other embodiments, a friction fit may be provided between both flange 348 and recess 366, and between shaft 350 and aperture 342. In some embodiments, flange 348 can have a thickness 349 in a range from about 1 mm to about 1.5 mm, for example in a range from about 1.15 to about 1.25 mm, including all ranges and subranges therebetween.

Each mounting post 332 comprises a threaded passage 354 extending along longitudinal axis 356 of shaft 350. In some embodiments, threaded passage 354 can extend entirely through mounting post 332, although in further embodiments, threaded passage 354 may extend through a portion of or all of shaft 350 but not flange 348. The one or more mounting posts 332 can be sized to fit within through-passage 40 of optical sight 10, extending upward into the through-passage when optical sight 10 is mounted to optical sight adapter 300. Threaded fastener 42 can thereafter be used to couple optical sight 10 to optical sight adapter 300. That is, threaded fastener 42 can be inserted into through-passage 40 and engaged with mounting post 332 via threaded passage 354, thereby coupling optical sight 10 to optical sight adapter 300. Mounting post 332 can provide an extended thread engagement compared to a threaded passage extending through a thin adapter plate only. That is, because a length of mounting post 332 is greater than thickness 308 of adapter plate 302, mounting post 332 can provide greater thread engagement for a threaded fastener, thereby increasing the strength of the engagement. Additionally, because mounting post 332 is configured to extend into through-passage 40 of optical sight 10, optical sight 10 may be able to more robustly withstand shock associated with slide recoil without the optical sight shifting position. Moreover, because mounting posts 332 are removable without damaging the optical sight adapter, if a mounting post is damaged (e.g., broken), the damaged mounting post can be individually replaced without discarding and replacing the entire optical sight adapter. Removable mounting post 332 may be formed from stainless steel or other suitable corrosion-resistant metal to prevent corrosion of the mounting post, and when combined with a polymer or aluminum adapter plate and recoil buffer, optical sight adapter 300 can provide a light weight but strong mounting apparatus for mounting optical sight 10 to handgun 100.

In various embodiments, mounting post 332 can be configured to resist rotation of mounting post 332 about longitudinal axis 352 when a torque is applied to the mounting post, such as might occur when a fastener is engaged in threaded passage 354 when mounting an optical sight to the sight adapter. That is, flange 348 can be circularly asymmetric relative to longitudinal axis 356 such that a line segment extending orthogonally from longitudinal axis 356 and terminating at a periphery of flange 348 varies in length as the line segment is rotated about longitudinal axis 356. Moreover, when mounting post 332 is engaged in socket 334 and longitudinal axis 356 is coaxial with longitudinal axis 352, flange 348 is circularly asymmetric relative to longitudinal axis 352. This configuration ensures that if a torque is applied to mounting post 332 engaged in socket 334 with longitudinal axis 356 coaxial with longitudinal axis 352, flange 348 is unable to turn within complementarily shaped recess 336. In some embodiments, flange 348 may be circular and still resist rotation if a longitudinal axis of the circular flange is offset from longitudinal axis 352 as previously described. Put another way, flange 348 should be configured such that the flange (e.g., a periphery thereof) is circularly asymmetric relative to longitudinal axis 352.

To mount optical sight 10 to slide 104, optical sight adapter 300 can be secured within recessed area 118 by inserting mounting post 332 into socket 334 so that shaft 350 extends above first mounting surface 304, then inserting optical sight adapter 300 into recessed area 118 so that second mounting surface 306 of optical sight adapter 300 contacts bottom surface 120 of recessed area 118. Accordingly, mounting post 332 is captured between socket 334 and bottom surface 120 of recessed area 118. If recessed area 118 comprises an orientation feature 126, for example a raised ridge or a recess, a complementary feature on second mounting surface 306, such as recessed channel 358 or a raised feature such as a post or pin, can be engaged with orientation feature 126. With optical sight adapter 300 in place in recessed area 118, optical sight adapter 300 can be secured to slide 104 by inserting threaded fastener 124 through aperture 330 and into engagement with threaded passages 122, and then tightening the threaded fastener. As shown in FIGS. 12 and 14, optical sight adapter 300 may include a plurality of apertures 330, for example a pair of apertures 330.

Once optical sight adapter 300 is secured to slide 104, optical sight 10 can be positioned on optical sight adapter 300 so that registration pins 328 are received into recesses 44, and mounting post 332 is received into through-passage 40. Threaded fastener 42 can then be inserted into through-passage 40 and engaged with mounting post 332 via threaded passage 354 and the threaded fastener thereafter tightened to secure optical sight 10 to optical sight adapter 300. As shown in FIGS. 12 and 14, optical sight adapter 300 may include a plurality of mounting posts 332, for example a pair of mounting posts 332.

Figure 19:
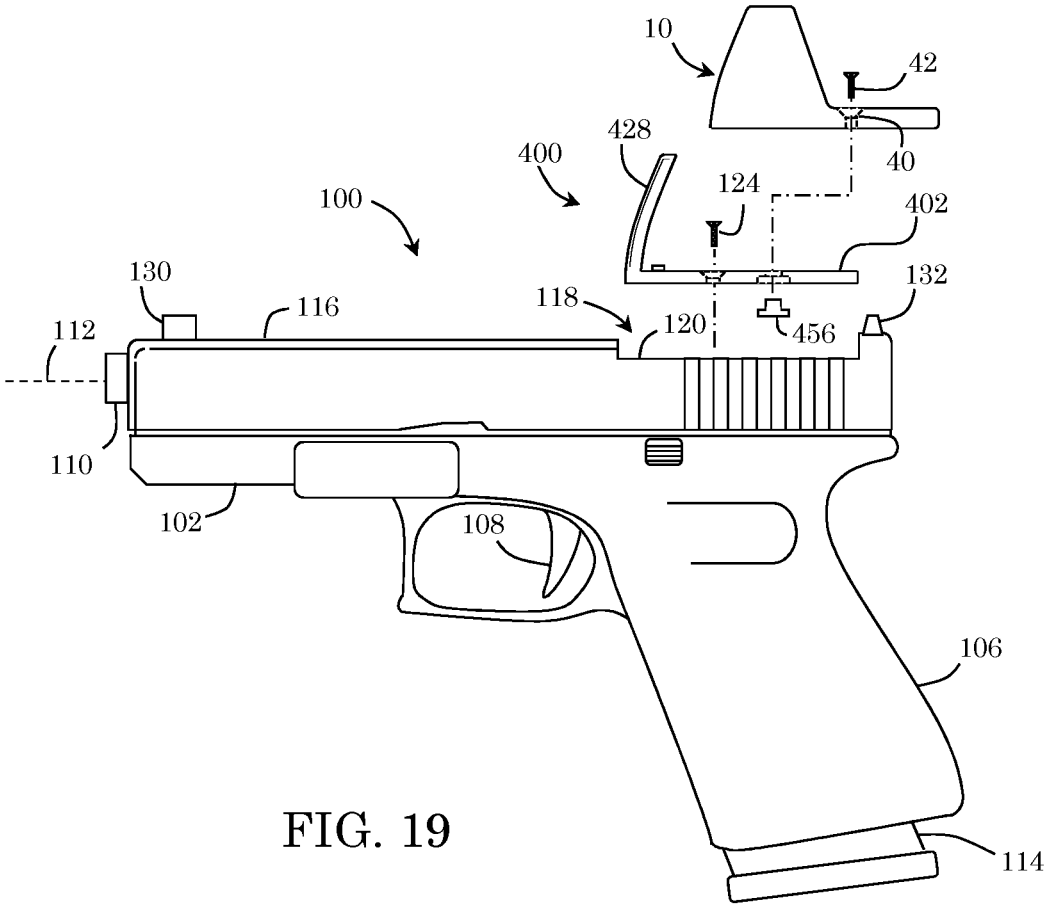
FIG. 19 is a side, partially exploded, schematic view of an exemplary handgun including another embodiment of an optical sight adapter and an optical sight mounted to the handgun with the optical sight adapter.
Figure 20:
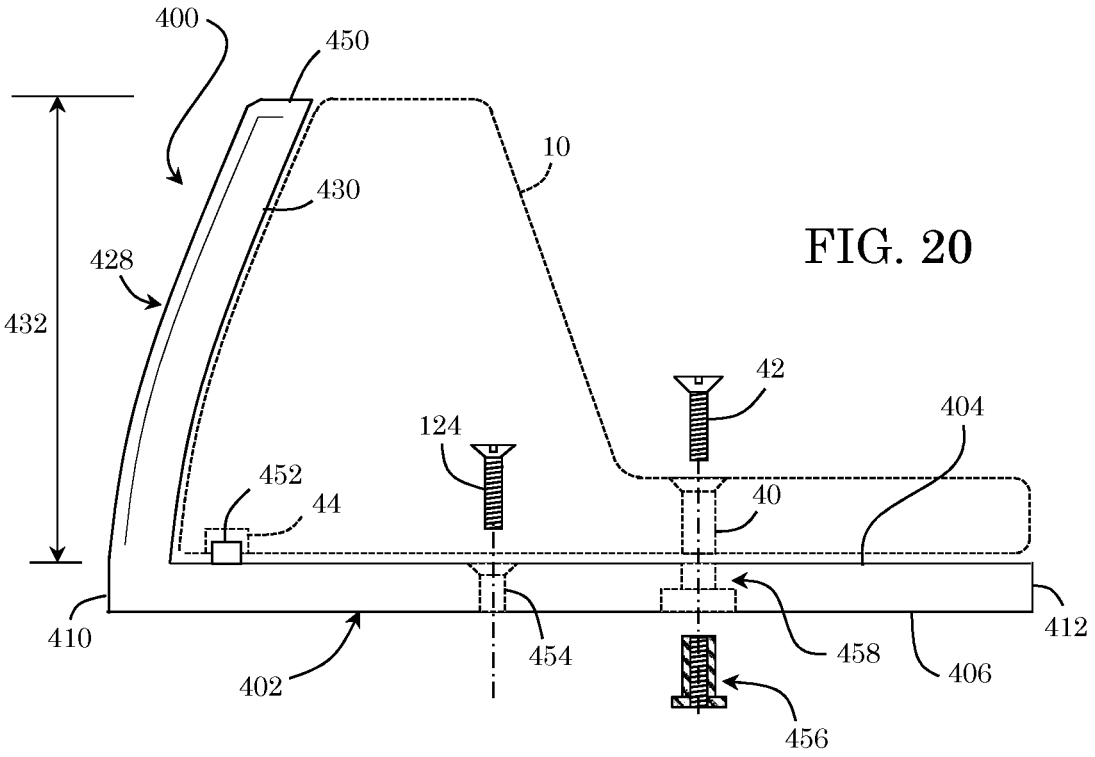
FIG. 20 is a schematic side view of the optical sight adapter of FIG. 19 showing the socket and removable mounting post, the removable mounting post shown in cross-section.

Turning now to FIG. 19, handgun 100 is shown including another exemplary optical sight adapter 400 for mounting optical sight 10 to handgun 100. As shown FIGS. 20-24 and 25A-25B, optical sight adapter 400 according to some embodiments comprises a generally rectangular adapter plate 402 comprising a first (upper) mounting surface 404 (FIG. 22), a second (lower) mounting surface 406 (FIG. 23), and a thickness 408 defined between first mounting surface 404 and second mounting surface 406 along a normal to at least one of the first or second mounting surfaces (see FIG. 24). In various embodiments, thickness 408 of adapter plate 402 can be in a range from about 2 mm to about 4 mm, for example in a range from about 2.0 mm to about 3.5 mm, such as in a range from about 2.0 mm to about 3.0 mm, in a range from about 2.0 mm to about 2.5 mm, in a range from about 2.0 mm to about 2.4 mm, in a range from about 2.0 mm to about 2.2 mm, in a range from about 2.3 mm to about 4.0 mm, in a range from about 2.5 mm to about 4.0 mm, in a range from about 2.7 to about 4.0 mm, or in a range from about 3.0 mm to about 4.0 mm, including all ranges and subranges therebetween.

In various embodiments, first mounting surface 404 and second mounting surface 406 can be parallel to each other. In various embodiments, first mounting surface 404 and second mounting surface 406 can be generally planar. In some embodiments optical sight adapter 400 can be formed of a polymer (plastic) material, such as a polycarbonate or acrylonitrile butadiene styrene (ABS), for example by injection molding or 3D printing. However, in further embodiments, optical sight adapter 400 can be metal, for example machined, cast, or 3D-printed metal, such as but not limited to aluminum or an aluminum alloy. Optical sight adapter 400 further comprises a first (forward) end 410 and a second (rear) end 412 defining a length 414 therebetween, and side edge surfaces 416 and 418 defining a width 420 therebetween orthogonal to length 414. Length 414 and width 420 will depend on the design of slide 104 and more particularly the length and width of recessed area 118 and the length and width of optical sight 10. However, by way of example and not limitation, in some embodiments, length 414 can be in a range from about 4 cm to about 6 cm, for example in a range from about 4.2 cm to about 5.5 cm, such as in a range from about 4.5 cm to about 5.2 cm, including all ranges and subranges therebetween. Width 420 can be in a range from about 2.5 cm to about 3 cm, for example in a range from about 2.6 cm to about 2.8 cm, including all ranges and subranges therebetween. Side edge surfaces 416, 418 can, in various embodiments, be flat surfaces and extend parallel to one another. However, in further embodiments, side edge surfaces 416, 418 may include channels, raised areas, or other gripping features used to manipulate slide 104. Such gripping features may correspond to similar gripping features located on slide 104. As previously described, sharp edges on adapter plate 402 may cause injury to the shooter as the slide reciprocates during discharge of the handgun. Accordingly, in some embodiments, at least one of first side edge surface 416 or second side edge surface 418 may comprise a chamfer 422 (see FIG. 24). For example, chamfer 422 may connect with second mounting surface 406 but not first mounting surface 404, although in further embodiments, chamfer 422 may connect with first mounting surface 404 but not second mounting surface 406, while in still further embodiments, chamfer 422 may connect to both the first mounting surface and the second mounting surface. That is, in some embodiments, only a portion of first side edge surface 416 and/or second side edge surface 418 may be chamfered, such as a bottom portion or a top portion of the side edge surfaces. In addition, chamfer 422 can provide a transition from a width of the slide recessed area to a width of optical sight 10. That is, in some embodiments, a width of optical sight 10 (in a direction orthogonal to longitudinal axis 112) may be greater than a width of recessed area 118.

Thus, chamfer 422 can provide both a functional and an aesthetic transition from the width of the recessed area to the width of the optical sight.

In some embodiments, first end 410 may further comprise a recess 424 (see FIGS. 21A and 21B) connected to second mounting surface 406 and extending in a width-wise direction across at least a portion of first end 410. Recess 424 can be configured to receive upper surface 116 of slide 104 when optical sight adapter 400 is mounted in recessed area 118. That is, recess 424 is sized and positioned such that when optical sight adapter 400 is mounted in recessed area 118, at least a portion of slide 104 can be inserted into recess 424 and upper wall 426 of recess 424 extends over a portion of slide 104, e.g., slide upper surface 116.

Optical sight adapter 400 further comprises an integral recoil buffer 428 positioned at first (forward) end 410 and extending generally upright from first mounting surface 404. Thus, recoil buffer 428 and adapter plate 402 form a stiff, one-piece structure. Recoil buffer 428 can be configured to function as a spacer between optical sight 10 and forward surface 140 of recessed area 118, to provide support to optical sight 10 during recoil of slide 104, and to protect optical element 20 by recessing optical element 20 behind (rearward from) the recoil buffer. That is, in instances where optical sight 10 is shorter than recessed area 118, recoil buffer 428 can fill the space between a forward end of the optical sight and forward surface 140 of recessed area 118, thereby providing support to optical sight 10 during recoil of slide 104. Accordingly, recoil buffer 428 comprises a rear-facing support surface 430 with a shape complementary to forward end 26 of optical sight 10 so that when optical sight 10 is mounted on optical sight adapter 400, supporting contact between a forward surface of optical sight 10 (e.g., including a forward surface of canopy 18) and support surface 430 is maximized.

In some embodiments, a height 432 of recoil buffer 428 from first mounting surface 404 can be greater than about 0.25 times length 414, for example greater than about 0.3 times length 414, although other heights are contemplated. A width 433 of recoil buffer 428 at first mounting surface 404 can be at least 0.5 times width 420 of adapter plate 402, for example at least 0.75 times width 420, such as 0.8 times width 420. In some embodiments, a width 433 of recoil buffer 428 at first mounting surface 404 can be equal to width 420. Recoil buffer 428 can be about the same height above first mounting surface 404 as a height of optical sight 10 above first mounting surface 404 when optical sight 10 is mounted to optical sight adapter 400. Recoil buffer 428 may comprise a frame 434 comprising two side members 438, 440 extending upward from bottom member 436 and a cross-member 442 extending across a top of side members 438, 440, frame 434 defining an opening 444 sized to provide a viewing window through which a target picture can be viewed through optical sight 10 without obstructing the shooter's view of the target. Opening 444 can be sized according to optical sight 10, and in particular, opening 444 can be sized and shaped to conform to opening 46 of optical sight 10. Opening 444 may be D-shaped. In some embodiments, opening 444 can have a width 446 in a range from about 2 cm to about 3 cm, for example in a range from about 2 cm to about 2.8 cm, such as in a range from about 2 cm to about 2.5 cm, including all ranges and subranges therebetween. In some embodiments, opening 444 may have a height 448 in a range from about 1.5 cm to about 1.8 cm, such as in a range from about 1.6 cm to about 1.8 cm. Side members 438 and 440 can be directly forward of side members 48, and cross-member 442 can be directly forward of cross-member 50 when optical sight 10 is mounted on optical sight adapter 400.

Figure 21A:
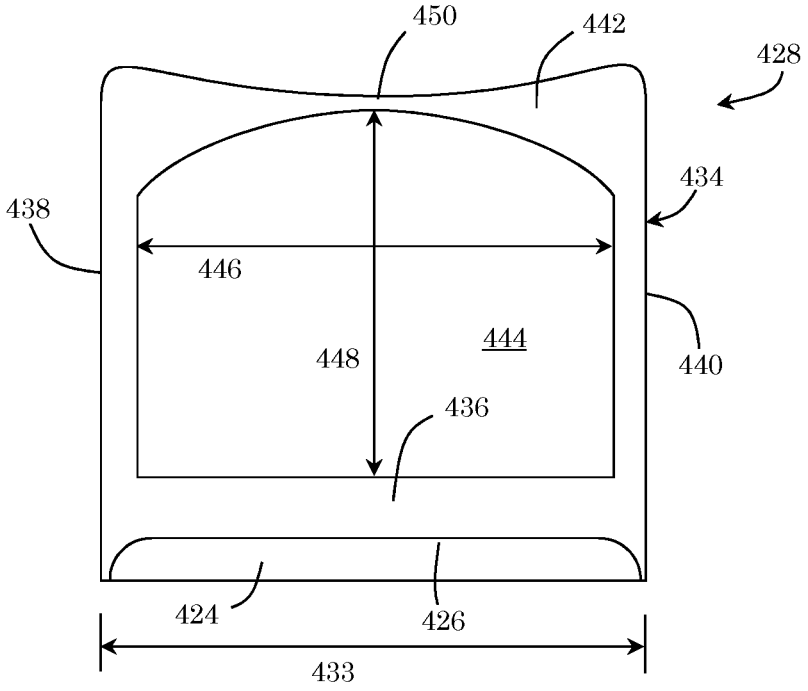
FIG. 21A is a schematic front view of the optical sight adapter of FIG. 19 comprising a downwardly concave upper surface.
Figure 21B:
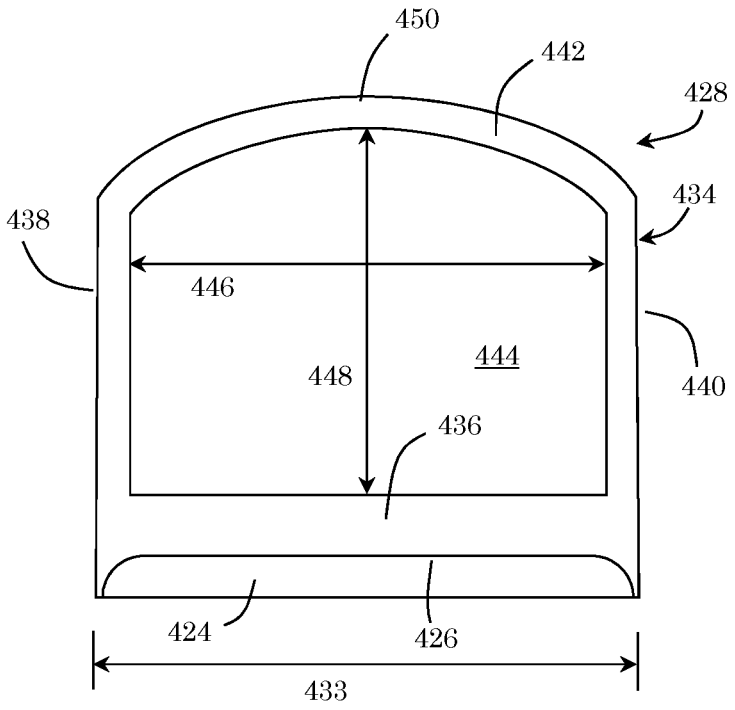
FIG. 21B is a schematic front view of the optical sight adapter of FIG. 19 comprising an upwardly convex upper surface.

In some embodiments, rear-facing support surface 430 may be flat and orthogonal to first mounting surface 404, while in further embodiments, rear-facing support surface 430 may be arcuate. In the embodiment depicted in FIG. 22, recoil buffer rear-facing support surface 430 can comprise a first, lateral curvature extending in a width-wise direction. In some embodiments, recoil buffer rear-facing support surface 430 may further comprise a second curvature orthogonal to the first curvature (see FIG. 20). In embodiments, recoil buffer 428 can curve backward from first end 410, in a direction toward second end 412. That is, recoil buffer 428 may have a convex curvature. In some embodiments, as shown in FIG. 21A, upper surface 450 of cross-member 442 may have an additional third curvature, for example a downwardly concave curvature, although in further embodiments, shown in FIG. 21B, upper surface 450 may comprise an upwardly convex curvature.

A frequent complaint voiced in respect of optical sights is a propensity to acquire smudges on front surface 22 of optical element 20, for example from fingerprints. When light beam 32 intersects smudges on front surface 22, the light can scatter, causing a halo around the indicium that can affect aiming. Moreover, attempts to remove the smudge, by wiping for example, may result in mishandling of the firearm to which the optical sight is attached, potentially leading to inadvertent and potentially dangerous discharge of the firearm. The instant embodiment can provide additional support and protection for optical sight 10. For example, by positioning optical element 20 of optical sight 10 behind frame 434, forward-facing optical element 20 can be better protected from inadvertent frontal contact, including impact damage. That is, optical sight 10 is positioned behind recoil buffer 428 with a forward surface of canopy 18 covered by frame 434 without obstructing the shooter's view through optical sight 10. Accordingly, contact with optical element 20 may be reduced and frontal impact absorbed by recoil buffer 428 rather than optical sight 10.

Figure 22:
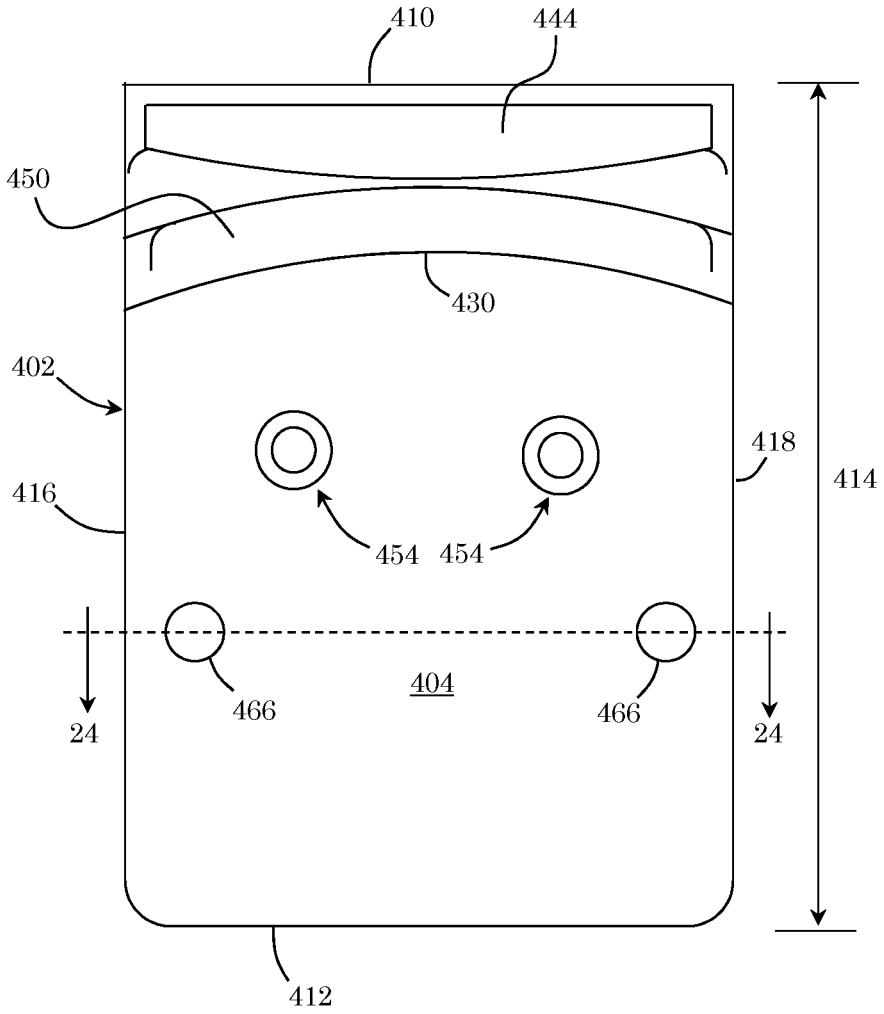
FIG. 22 is a top view of an upper mounting surface of the optical sight adapter of FIG. 19.
Figure 23:
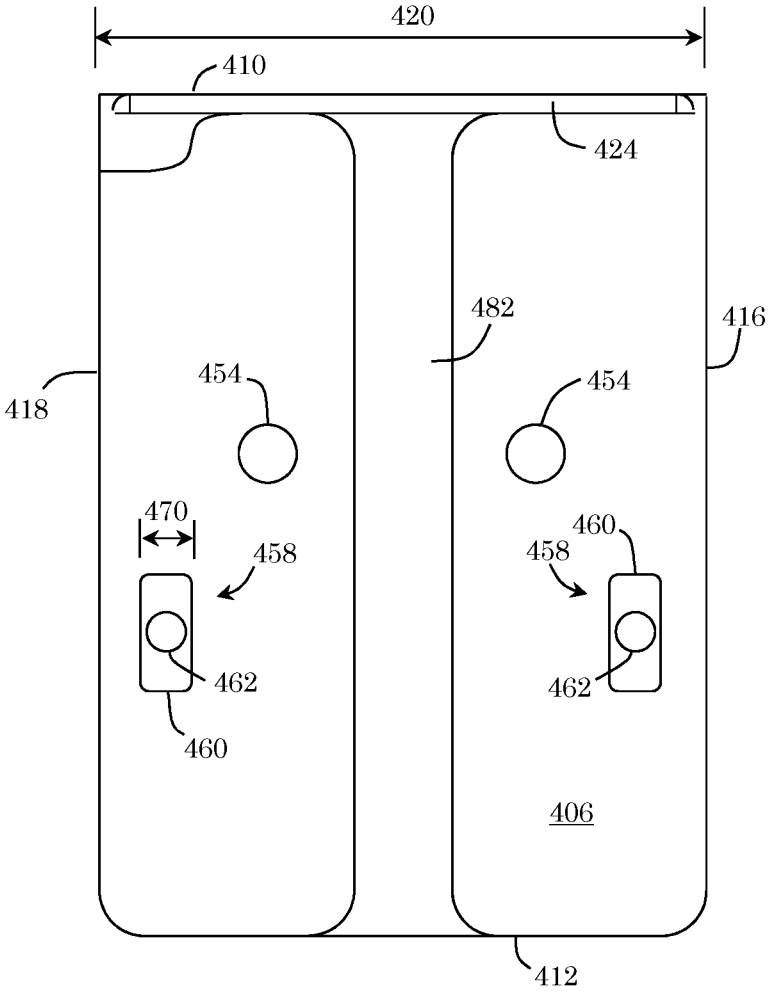
FIG. 23 is a bottom view of a lower mounting surface of the optical sight adapter of FIG. 19 showing the sockets disposed therein.
Figure 24:
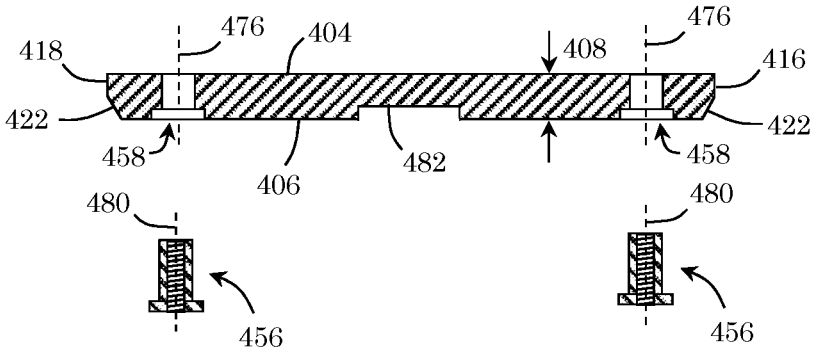
FIG. 24 is a cross-sectional view of the optical sight adapter of FIG. 19 taken along line 24-24 illustrating fastener sockets and removable mounting posts.

Referring to FIGS. 22 and 23, first mounting surface 404 is configured to engage with bottom mounting surface 16 of optical sight 10, while second mounting surface 406 is configured to engage with bottom surface 120 of recessed area 118. Accordingly, optical sight adapter 400, and in particular, adapter plate 402, functions as a mating interface between slide 104 and optical sight 10. First mounting surface 404 may comprise one or more registration pins 452 extending upward, for example orthogonally, from first mounting surface 404. Additionally, adapter plate 402 may include one or more apertures 454 for mounting optical sight adapter 400 to recessed area 118. Apertures 454 may comprise a chamfered upper surface connecting to first mounting surface 404. That is, the one or more apertures 454 may be countersunk to receive a fastener head, e.g., screw head. The chamfer can be any size or shape suitable to ensure the fastener head is at or below first mounting surface 404 when the fastener is tightened and engaged in the aperture.

In various embodiments, adapter plate 402 may further comprise one or more removable mounting posts 456 configured to removably engage in sockets 458 extending between second mounting surface 406 and first mounting surface 404. By removably engage what is meant is that mounting posts 456 can be friction-fit (e.g., an interference fit) within sockets 458 such that when mounting posts 456 are engaged in sockets 458, the mounting posts will not drop from the mounting sockets under their own weight when second mounting surface 406 is horizontal and facing down, but can be removed by applying an axial force against a top of a mounting post extending above first mounting surface 404. When engaged in socket 458, mounting post 456 may extend distance R as previously defined above first mounting surface 404 greater than about 1 mm, for example in a range from about 1 mm to about 3.5 mm, such as in a range from about 1.2 mm to about 3 mm, for example in a range from about 1.5 mm to about 2.7 mm, or in a range from about 2 mm to about 2.7 mm including all ranges and subranges therebetween. Removable mounting posts 456 may be formed from stainless steel or other suitable corrosion-resistant metal to prevent corrosion of the mounting posts, and when combined with a polymer adapter plate and recoil buffer, optical sight adapter 400 can provide a light weight but strong mounting apparatus for mounting optical sight 10.

Figure 25A:
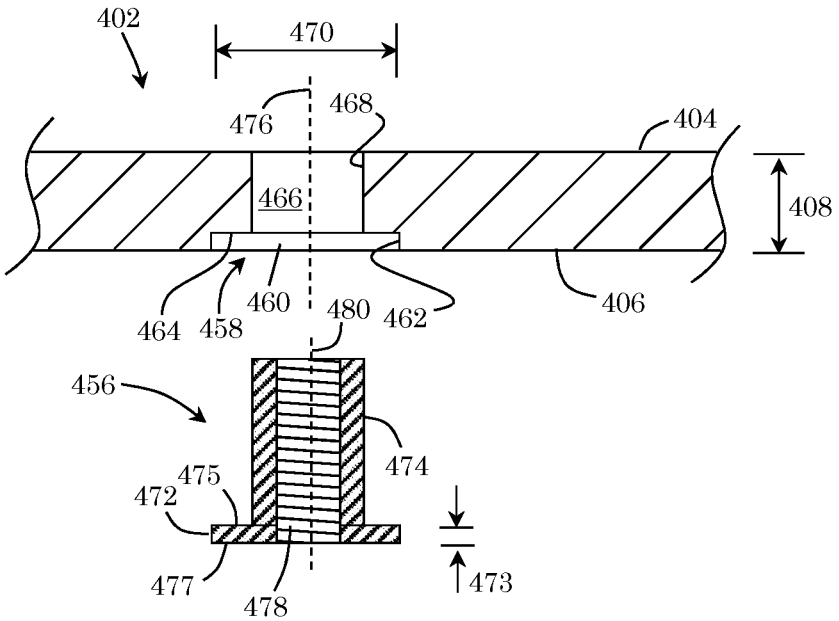
FIG. 25A is a close-up cross-sectional view of a socket and removable mounting post of FIG. 24.
Figure 25B:
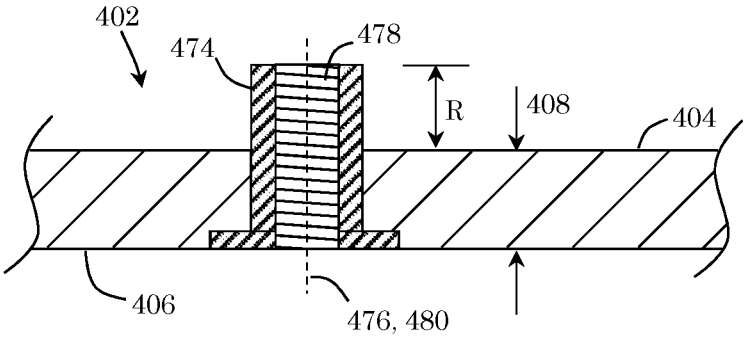
FIG. 25B is a close-up view of the socket and removable mounting post of FIG. 25A showing the removable mounting post inserted in the socket.

Referring to FIGS. 25A and 25B, each of the one or more sockets 458 comprises a recess 460 in second mounting surface 406, recess 460 defined by side wall 462 and bottom wall 464. Bottom wall 464 can be parallel with first mounting surface 404 and/or second mounting surface 406 and positioned intermediate between first mounting surface 404 and second mounting surface 406. Each of the one or more sockets 458 may further comprise an aperture 466 extending from bottom wall 464 through first mounting surface 404, aperture 466 defined by side surface 468. In embodiments, side surface 468 can be smooth. To wit, in some embodiments, side surface 468 of aperture 466 may not be threaded. In various embodiments, a minimum lateral dimension 470 of recess 460 is larger than a diameter of aperture 466. FIG. 25A is a cross-sectional side view of a socket 458 and a mounting post 456 shown disengaged from the socket, while FIG. 25B is a cross-sectional side view of the socket 458 and the mounting post 456 shown engaged with the socket.

Recess 460 may have a variety of possible peripheral geometric shapes. For example, in some embodiments, recess 460 may have a peripheral geometric shape comprising a generally rectangular shape. Corners of the geometric shape may be radiused. However, in further embodiments, recess 460 can have a star-shaped peripheral shape, an elliptical peripheral shape, a triangular peripheral shape, a pentagonal peripheral shape, and the like (refer to FIGS. 17-18). In some embodiments, recess 460 can even have a circular geometric shape.

Recess 460 may be circularly asymmetric with reference to longitudinal axis 476. As used herein, circularly symmetric means that for a line segment extending from and orthogonal to longitudinal axis 476 and terminating at side wall 462, as the line segment is rotated about longitudinal axis 476 a length of the line segment does not vary. Accordingly, circularly asymmetric means that for a line segment extending from and orthogonal to longitudinal axis 476 and terminating at side wall 462, as the line segment is rotated about longitudinal axis 476 a length of the line segment varies. It should be noted that a circular recess 460 with a center positioned such that longitudinal axis 476 passes through the center is circularly symmetric. However, if the center of the circle is offset from longitudinal axis 476 such that recess 460 is positioned eccentrically relative to longitudinal axis 476, the recess would be circularly asymmetric.

As described above, mounting post 456 can be removably engaged with socket 458.

Mounting post 456 comprises a flange 472 and a shaft 474 extending from the flange. A shape of flange 472 can be complementary to the shape of recess 460. That is, flange 472 can have the same geometric shape as recess 460 and be sized to provide a friction fit within recess 460. In other words, by way of example and not limitation, where recess 460 can comprise a generally rectangular shape, mounting post 456 may also comprise a flange 472 with a generally rectangular shape sized to provide a friction fit within recess 460 such that mounting post 456 is retained in socket 458. In addition, shaft 474 can have a geometric cross-sectional shape (e.g., outer diameter) that is about the same geometric shape and size as the interior shape of aperture 466. For example, if aperture 466 is cylindrical with a circular cross-sectional shape orthogonal to longitudinal axis 476 of aperture 466, shaft 474 can also have a circular cross-sectional shape. In accordance with some embodiments, an outside surface of shaft 474 can be smooth, without protrusions. In some embodiments, an outside cross-sectional dimension of shaft 474 may be sized to provide a friction fit with side surface 468 of aperture 466, although such friction fit may not be necessary if flange 472 provides a sufficient friction fit with recess 460, while in still other embodiments, a friction fit may be provided between both flange 472 and recess 460, and between shaft 474 and aperture 466. In some embodiments, flange 472 can have a thickness 473 in a range from about 1 mm to about 1.5 mm, for example in a range from about 1.15 to about 1.25 mm, including all arranges and subranges therebetween. In some embodiments, major surfaces 475 and 477 of flange 472 may be planar and include no protrusion.

Each mounting post 456 defines a threaded passage 478 extending along a longitudinal axis 480 of shaft 474. In some embodiments, threaded passage 478 can extend entirely through mounting post 456. However, in other embodiments, threaded passage 478 may extend through a portion of or all of shaft 474 but not flange 472. The one or more mounting posts 456 are sized to fit within through-passage 40 of optical sight 10, extending upward into through-passage 40, wherein threaded fastener 42 can be used to secure optical sight 10 to optical sight adapter 400. That is, threaded fastener 42 can be inserted into through-passage 40 and engaged with mounting post 456 via threaded passage 478, thereby securely coupling optical sight 10 to optical sight adapter 400. Mounting posts 456 provide extended thread engagement compared to a threaded passage extending through a thin adapter plate only. That is, mounting post 456 provides greater thread count for a threaded fastener to engage with, thereby increasing the strength of the engagement. Accordingly, the threads of threaded passage 478 extend above first mounting surface 404 when mounting post 456 is fully engaged in socket 458 and can extend through an entire length of the mounting post. Because mounting post 456 is configured to extend into through-passage 40 of optical sight 10, optical sight 10 is better able to withstand the shock associated with slide recoil without the optical sight shifting position. Moreover, because mounting posts 456 are removable from optical sight adapter 400 without damaging the optical sight adapter (e.g., adapter plate 402), if a mounting post is damaged (e.g., broken), the damaged mounting post can be individually replaced without discarding and replacing the entire optical sight adapter.

In various embodiments, mounting post 456 can be configured to resist rotation about longitudinal axis 480 when a torque is applied to the mounting post when the mounting post is engaged in socket 458. For example, flange 472 can be shaped such that for a line segment extending orthogonally from longitudinal axis 480 and terminating at a periphery of flange 472, as the line segment is rotated about longitudinal axis 480, the line segment varies in length. The flange is circularly asymmetric relative to longitudinal axis 480. Moreover, when mounting post 456 is engaged in socket 458 and longitudinal axis 480 is coaxial with longitudinal axis 476, flange 472 is circularly asymmetric relative to longitudinal axis 476. This circular asymmetry ensures that if a torque is applied to mounting post 456 engaged in socket 458 with longitudinal axis 480 coaxial with longitudinal axis 476, flange 472 is unable to turn within similarly shaped recess 460, thereby preventing rotation of mounting post 456. In some embodiments, flange 472 may be circular and still resist rotation if a center of the circular flange is offset from longitudinal axis 476 as previously described. Put another way, flange 472 should be configured such that the flange (e.g., a periphery thereof) is circularly asymmetric with reference to longitudinal axis 476 when the mounting post is engaged in socket 458.

To mount optical sight 10 to slide 104, mounting post 456 is inserted into socket 458 so that shaft 474 extends above first mounting surface 404 and flange 472 is fully engaged in recess 460. For example, mounting post 456 can be inserted into socket 458 such that flange 472 is flush with second mounting surface 406. Then, optical sight adapter is secured within recessed area 118 by inserting optical sight adapter 400 into recessed area 118 so that second mounting surface 406 of optical sight adapter 400 contacts bottom surface 120 of recessed area 118. If recessed area 118 comprises an orientation feature 126, for example a raised ridge or a recess, a complementary feature on second mounting surface 406, such as recessed channel 482 or a raised portion (e.g., pin or post), can be engaged with orientation feature 126. With optical sight adapter 400 in place in recessed area 118, the optical sight adapter can be secured to slide 104 by inserting threaded fasteners 124 through apertures 454 and into engagement with threaded passages 122, after which the threaded fasteners can be tightened.

Once optical sight adapter 400 is secured to slide 104, optical sight 10 can be positioned on optical sight adapter 400 so that registration pins 452 are received into recesses 44, mounting post 456 is received into through-passage 40, and threaded fastener 42 is inserted into through-passage 40 and engaged with mounting post 456 via threaded passage 478 and the threaded fastener tightened to secure optical sight 10 to optical sight adapter 400. In embodiments, optical sight adapter 400 may comprise a plurality of sockets and removable mounting posts.

In still further embodiments, an optical sight adapter using a removable mounting post may be configured with a socket comprising a circularly shaped (e.g., cylindrical) recess with a center of the circularly shaped recess coaxial with a central longitudinal axis of an aperture connected therewith. Thus, an optical sight adapter 500 is provided for mounting optical sight 10 to handgun 100. Optical sight adapter 500 can be identical or substantially identical to optical sight adapter 300 described above, with the exception of the sockets 534 described in detail below.

Figure 26:
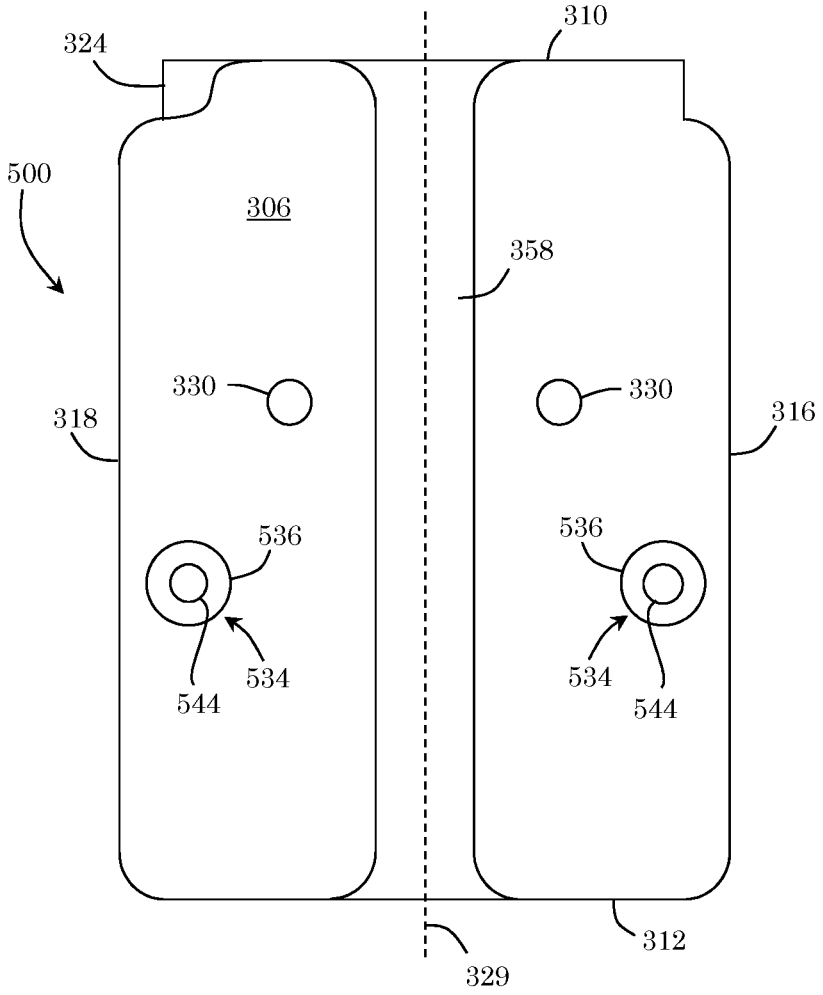
FIG. 26 is a. schematic view of an exemplary optical sight adapter according to an embodiment of the present disclosure and showing a lower mounting surface of the optical sight adapter comprising sockets with circular recesses for receiving fasteners with circular heads.
Figure 27:
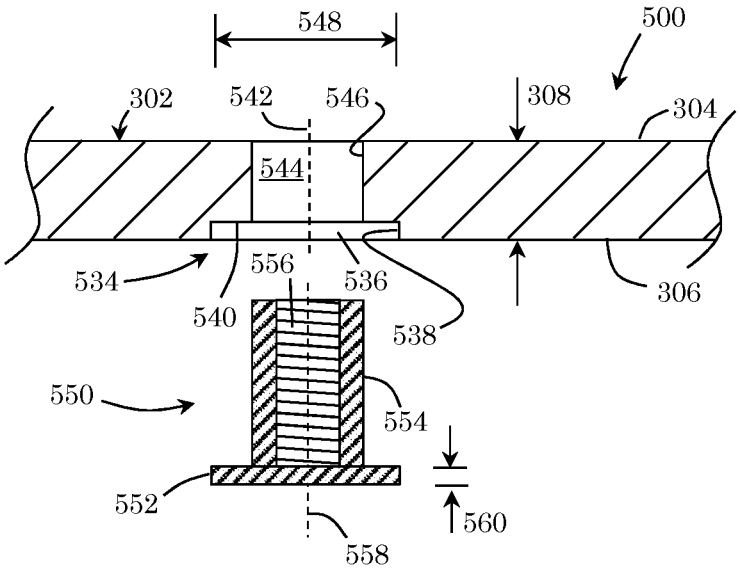
FIG. 27 is a close-up view of the socket of FIG. 26 showing details of the socket and mounting post.

Referring to FIGS. 26 and 27 showing a bottom view of optical sight adapter 500 and a cross-sectional view of a socket 534, respectively, each of the one or more sockets 534 can comprise a recess 536 in second mounting surface 306, recess 536 defined by side wall 538 and bottom wall 540, bottom wall 540 positioned intermediate first mounting surface 304 and second mounting surface 306. Bottom wall 540 can be parallel to either one or both first mounting surface 304 and second mounting surface 306. In accordance with the present embodiment, recess 536 comprises a circular geometric shape in a plane orthogonal to longitudinal axis 542, e.g., recess 536 is circularly symmetric with reference to longitudinal axis 542.

Bottom wall 540 may be parallel with first mounting surface 304 and/or second mounting surface 306. Each of the one or more sockets 534 may further comprise an aperture 544 extending along longitudinal axis 542, for example a cylindrical aperture with a circular cross-section in a plane orthogonal to longitudinal axis 542, extending from bottom wall 540 through first mounting surface 304, aperture 544 defined by a side surface 546. In embodiments, side surface 546 can be smooth. In various embodiments, a diameter of recess 536 is larger than a diameter of aperture 544.

As described for socket 334, socket 534 is configured to receive a removable mounting post 550. As shown in FIG. 27, mounting post 550 comprises a flange 552 and a shaft 554 extending orthogonally therefrom. Shaft 554 includes a threaded passage 556 extending along a longitudinal axis 558 of shaft 554. In some embodiments, threaded passage 556 can extend entirely through mounting post 550, although in further embodiments, as shown, threaded passage 556 may extend through a portion of or all of shaft 554 but not flange 552. Mounting post 550 can be sized to fit within through-passage 40 of optical sight 10, extending upward into the through-passage when optical sight is mounted to optical sight adapter 500. Threaded fastener 42 can thereafter be used to couple optical sight 10 to optical sight adapter 500. That is, threaded fastener 42 can be inserted into through-passage 40 and engaged with mounting post 550 via threaded passage 556, thereby coupling optical sight 10 to optical sight adapter 500. Mounting post 550 can provide an extended thread engagement for a fastener (e.g., threaded fastener 42) compared to a threaded passage extending through a thin adapter plate only. That is, because a length of shaft 554 is greater than thickness 308 of adapter plate 302, mounting post 550 can increase the strength of the engagement. For example, because mounting post 550 is configured to extend into through-passage 40 of optical sight 10, optical sight 10 may be able to more robustly withstand shock associated with slide recoil without the optical sight shifting position. Moreover, because mounting post 550 is removable without damaging the optical sight adapter, if a mounting post is damaged (e.g., broken), the damaged mounting post can be individually replaced without discarding and replacing the entire optical sight adapter. Removable mounting post 550 may be formed from stainless steel or other suitable corrosion-resistant metal to prevent corrosion of the mounting post, and when combined with a polymer or aluminum adapter plate and recoil buffer, optical sight adapter 500 can provide a light weight but strong mounting apparatus for mounting optical sight 10 to handgun 100.

Mounting post 550 can provide a friction fit with socket 534. A shape of flange 552 can be complementary to the shape of recess 536. That is, flange 552 can have the same geometric shape as recess 536 and be sized to provide a friction fit within recess 536. In other words, where recess 536 comprises a circular cross-sectional shape in a plane orthogonal to longitudinal axis 542, mounting post 550 may comprise a flange 552 with a circular cross-sectional shape. Longitudinal axis 558 of shaft 554 can be coaxial with longitudinal axis 542 of aperture 544 when mounting post 550 is fully engaged in socket 534. Flange 552 can be sized to provide a friction fit within recess 536 such that mounting post 550 can be retained in socket 534. In some embodiments, flange 552 can have a thickness 560 in a range from about 1 mm to about 1.5 mm, for example in a range from about 1.15 to about 1.25 mm, including all ranges and subranges therebetween.

Figure 28:
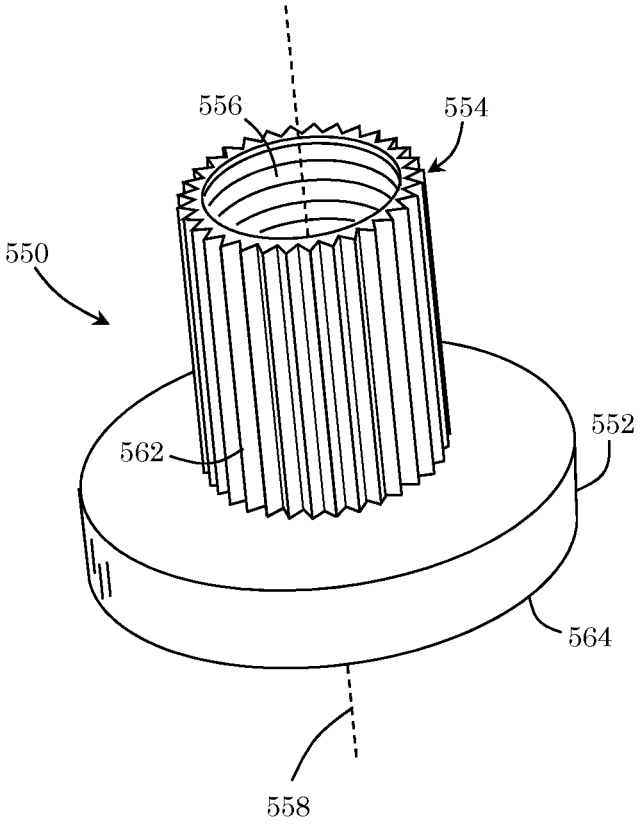
FIG. 28 is a perspective view of an exemplary fastener with a circular head and a shaft comprising ridges to resist rotation when the mounting post is engaged in the socket of FIG. 26.

In various embodiments, mounting post 550 can be configured to resist rotation about longitudinal axis 558 when a torque is applied to the mounting post if the mounting post is engaged in socket 534, such as might occur when a fastener is engaged in threaded passage 556 when mounting an optical sight to the sight adapter. Accordingly, in some embodiments, shaft 554 may include elongate raised and/or recessed features 562, e.g., ridges (e.g., splines) and/or channels, which aid in resisting rotation of the mounting post if the mounting post is engaged in socket 534 and a fastener is engaged in threaded passage 556, rotated, and tightened. While the elongate features 562 shown in FIG. 28 are linear and parallel with longitudinal axis 558, in further embodiments, the elongate features may be helical. In some embodiments, side surface 546 may include elongate features complementary to elongate features 562 and configured such that the elongate features of shaft 554 engage in or between the elongate features of side surface 546, thereby preventing rotation of mounting post 550 within socket 534.

While not shown, in some embodiments, elongate features 562 can be helical and spiral about shaft 554 in a direction opposite to that of the threads lining the interior of threaded passage 556. In various embodiments, side surface 546 can be provided with complementary helical features, such as elongate ridges and/or channels. Thus, in some embodiments, mounting post 550 can be rotated into aperture 544. For example, while not shown in FIG. 28, flange 552 can be provided with an outer engagement surface 564 configured to fit a driving device (e.g., screwdriver, hex wrench, etc.). Rotating mounting post 550 into socket 534 via helical features on shaft 554 and complimentary helical features on side surface 546 can seat the mounting post firmly in socket 534. Threading a fastener into threaded passage 556 of mounting post 550, such as when attaching an optical sight to the adapter, can further tighten the mounting post in the socket, thereby avoiding loosening of the mounting post when attaching the optical sight via a fastener screwed into mounting post 550. In some embodiments, helical elongate features can be configured with a twist rate that allows mounting post 550 to be seated in socket 534 with a short twist, for example less than a single rotation. In some embodiments, an external surface of shaft 554 may be threaded, and side surface 546 may be provided with complementary threads such that mounting post 550 can be screwed into socket 534 using one or more turns. The external threads may be in an opposite direction from the internal threads of threaded passage 556.

When engaged in socket 534, mounting post 550 may extend a distance R (see FIG. 16B) above first mounting surface 304 greater than about 1 mm, for example in a range from about 1 mm to about 3.5 mm, such as in a range from about 1.2 mm to about 3 mm, for example in a range from about 1.5 mm to about 2.7 mm, or in a range from about 2 mm to about 2.7 mm including all ranges and subranges therebetween. Removable mounting posts 550 may be formed from stainless steel or other suitable corrosion-resistant metal to prevent corrosion of the mounting posts. Thus, mounting posts 550 can provide strong retainment of an optical sight even if the adapter plate is formed from a relatively soft metal, such as aluminum, or even a polymer.

Figure 29:
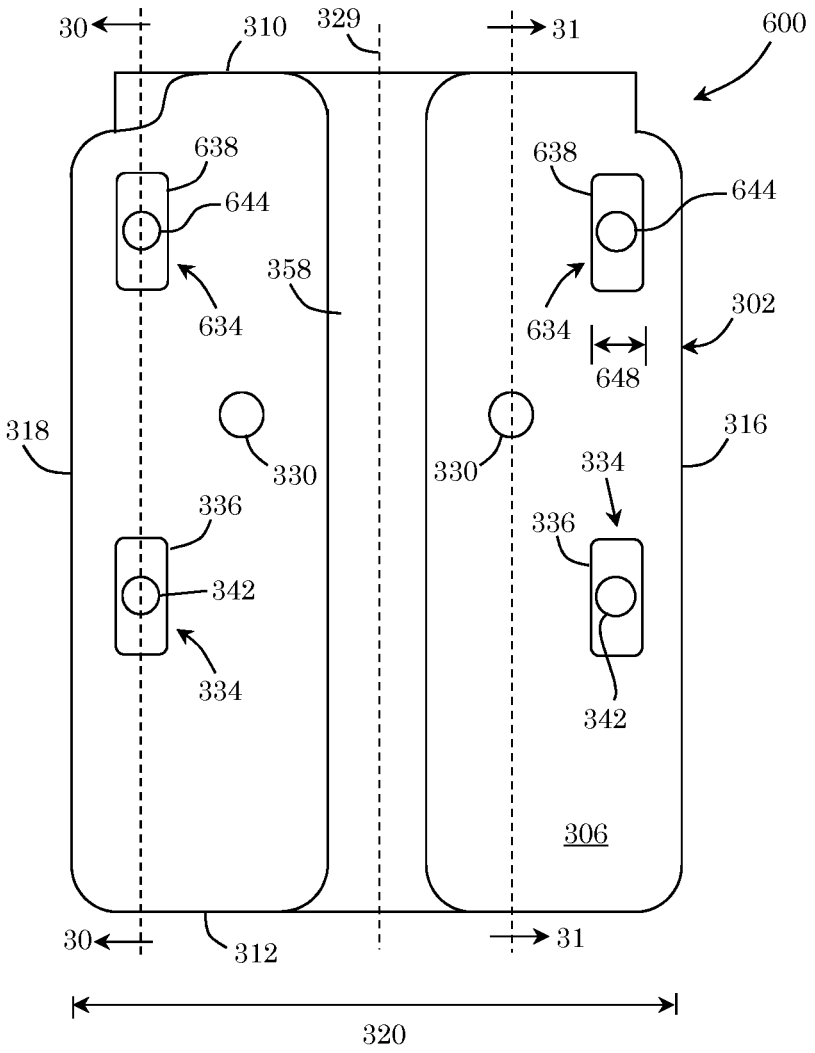
FIG. 29 is a schematic top view of an optical sight adapter comprising a forward and a rear recoil buffer, and further including centerline apertures for receiving positioning protrusions from a firearm surface.

In other embodiments, an optical sight adapter according to the present disclosure can comprise removable registration pins. Thus, registration pins, for example with solid interiors, can be removably engaged in registration pin sockets in an adapter plate in a manner the same or similar to the manner in which removable mounting posts with hollow interiors are engaged with adapter plates. Shown in FIG. 29 is schematic view of a bottom surface of an optical sight adapter 600. Optical sight adapter 600 can be, in various embodiments, identical to optical sight adapter 300 with the exception that fixed registration pins 328 are replaced with removable registration pins in a manner similar to removable mounting posts 332. Accordingly, optical sight adapter 600 comprises an adapter plate 302 comprising a first (upper) mounting surface 304 and a second (lower) mounting surface 306. Adapter plate 302 includes a first side edge surface 316 and a second side edge surface 318, and a width 320 extending therebetween. Adapter plate 302 further comprises a socket 334 for receiving a removable mounting post 332 as previously described. However, in further embodiments, adapter plate 302 may comprise a socket 534 for receiving a removable mounting post 550 as previously described.

Figure 30:
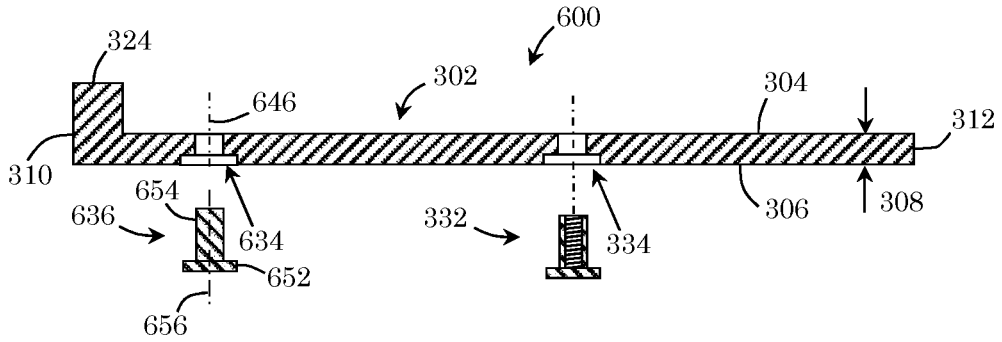
FIG. 30 is a longitudinal cross-sectional view of the optical sight adapter of FIG. 29 taken along line 30-30.
Figure 31:
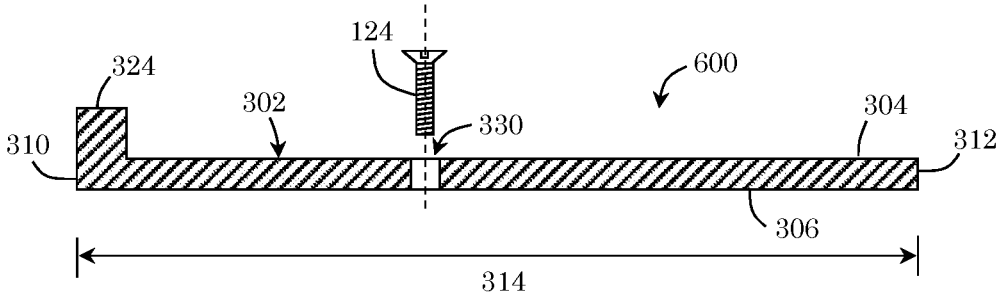
FIG. 31 is a cross-sectional view of the optical sight adapter of FIG. 29 taken along line 31-31.

Referring to FIGS. 29-32, in various embodiments, adapter plate 302 may further comprise one or more sockets 634 configured to receive a removable registration pin 636. Whereas FIG. 29 is a bottom view of second mounting surface 306 of optical sight adapter 600, FIG. 30 is a cross-sectional side view of the optical sight adapter 600 of FIG. 29 taken along line 30-30 showing multiple sockets, a removable mounting post, and a removable registration pin. FIG. 31 is another cross-sectional side view of optical sight adapter 600 taken along line 31-31 showing aperture 330 as previously described in respect of optical sight adapter 300 extending from first mounting surface 304 to second mounting surface 306 of adapter plate 302 for receiving threaded fastener 124 therethrough such that threaded fastener 124 can be used to couple optical sight adapter 600 to recessed area 118. Adapter plate 302 can include multiple apertures 330.

Figure 32:
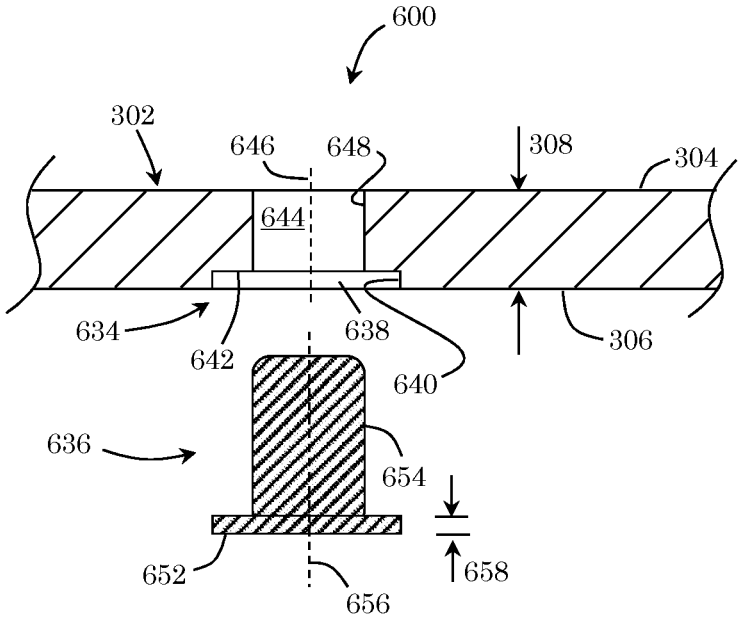
FIG. 32 is a close-up cross-sectional view of a socket of the optical sight adapter of FIG. 29 for receiving a removable registration pin.

Referring to FIG. 32, each of the one or more sockets 634 can comprise a recess 638 in second mounting surface 306, recess 638 defined by side surface 640 and bottom wall 642, bottom wall 642 positioned intermediate first mounting surface 304 and second mounting surface 306. Bottom wall 642 may be parallel with first and/or second mounting surface 304, 306. Each of the one or more sockets 634 may further comprise an aperture 644 extending along longitudinal axis 646 from bottom wall 642 through first mounting surface 304, aperture 644 defined by side surface 648. Longitudinal axis 646 extends through a center of aperture 644. In embodiments, side surface 648 can be smooth. To wit, in some embodiments, side surface 648 of aperture 644 may not be threaded.

Recess 638 may have a variety of possible peripheral geometric shapes. For example, recess 638 may have a generally rectangular shape (see FIG. 17). Corners of the recess shape may be radiused. However, in further embodiments, recess 638 can have a star-shaped peripheral shape (see FIG. 18), an elliptical peripheral shape, a triangular peripheral shape, a pentagonal peripheral shape, and the like. Recess 638 can be circularly asymmetric relative to longitudinal axis 646. However, because removable registration pin 636 is not required to resist rotation, in some embodiments, recess 638 can have a circular geometric shape. That is, recess 638 may be circularly symmetric such that recess 638 comprises a circular cross-sectional shape with a center that lies on longitudinal axis 646 (e.g., recess 638 and aperture 644 are arranged coaxially) as explained below).

Removable registration pin 636 comprises a flange 652 and a shaft 654 extending therefrom, e.g., orthogonal to flange 652 along longitudinal axis 656. Registration pin 636 can be sized to fit within recess 44 of optical sight 10, extending upward into recess 44 when optical sight 10 is mounted to optical sight adapter 600. Registration pin 636 can aid in positioning of optical sight 10 on optical sight adapter 600 and, because registration pin 636 is configured to extend into recess 44 of optical sight 10, optical sight 10 may be able to more robustly withstand shock associated with slide recoil without the optical sight shifting position. Moreover, because registration pin 636 is removable without damaging the optical sight adapter, if a registration pin is damaged (e.g., broken), the damaged registration pin can be individually replaced without discarding and replacing the entire optical sight adapter. Removable registration pin 636 may be formed from stainless steel or other suitable corrosion-resistant metal to prevent corrosion of the registration pin, and when combined with a polymer or aluminum adapter plate and recoil buffer, optical sight adapter 600 can provide a light weight but strong mounting apparatus for mounting optical sight 10 to handgun 100.

Registration pin 636 can provide a friction (interference) fit with socket 634. A shape of flange 652 can be complementary to the shape of recess 638. That is, flange 652 can have the same geometric shape as recess 638 and be sized to provide an interference fit within recess 638. In other words, where recess 638 comprises a circularly asymmetric periphery relative to longitudinal axis 646, flange 652 may comprise a similarly circularly asymmetric periphery relative to longitudinal axis 656 (wherein, when removable registration pin 636 is engaged in socket 634, longitudinal axis 656 is coaxial with longitudinal axis 646). Where recess 638 comprises a circularly symmetric periphery, e.g., a circular cross-sectional shape in a plane orthogonal to longitudinal axis 646, registration pin 636 may also comprise a flange 652 with a circularly symmetric peripheral shape relative to longitudinal axis 656. Flange 652 can be sized to provide an interference fit within recess 638 such that registration pin 636 can be retained in socket 634. In some embodiments, flange 652 can have a thickness 658 in a range from about 1 mm to about 1.5 mm, for example in a range from about 1.15 to about 1.25 mm, including all ranges and subranges therebetween.

Unlike removable mounting posts previously described, registration pin 636 can have a solid construction without a threaded internal passage. That is, in various embodiments, registration pin 636 is not hollow and has no interior passages. Accordingly, as previously described, removable registration pin 636 need not resist rotation if a torque is applied to the mounting post. Nevertheless, in some embodiments, shaft 654 may include an elongate raised and/or recessed feature, e.g., at least one elongate ridge or channel similar to or identical to removable mounting post 550, which may aid in producing an interference fit that retains registration pin 636 in socket 634. In some embodiments, the at least one ridge on an exterior surface of shaft 654 may include a thread, wherein an interior of side surface 648 of aperture 644 may include a complementary thread so that removable registration pin 636 can be screwed into socket 634. However, in such instances, only a portion of shaft 654 may be threaded, e.g., a portion that does not extend above first mounting surface 304. Shaft 654 may be any suitable cross-sectional shape. For example, shaft 654 may have a circular cross-sectional shape in a plane orthogonal to longitudinal axis 656, a portion of a circular shape, e.g., a semi-circular shape, a rectangular shape, a triangular shape, and so forth. Aperture 644 may be similarly shaped.

When engaged in socket 634, registration pin 636 (e.g., shaft 654) may extend above first mounting surface 304 greater than about 1 mm, for example in a range from about 1 mm to about 3.5 mm, such as in a range from about 1.2 mm to about 3 mm, for example in a range from about 1.5 mm to about 2.7 mm, or in a range from about 2 mm to about 2.7 mm including all ranges and subranges therebetween. Removable registration pin 636 may be formed from stainless steel or other suitable corrosion-resistant metal to prevent corrosion of the registration pin. Thus, whereas an integral registration pin is necessarily formed of the same material as the adapter plate from which it extends, removable registration pin 636 is less likely to break and can provide strong retainment of an optical sight even if the adapter plate is formed from a relatively soft metal, such as aluminum, or a polymer.

Figure 33:
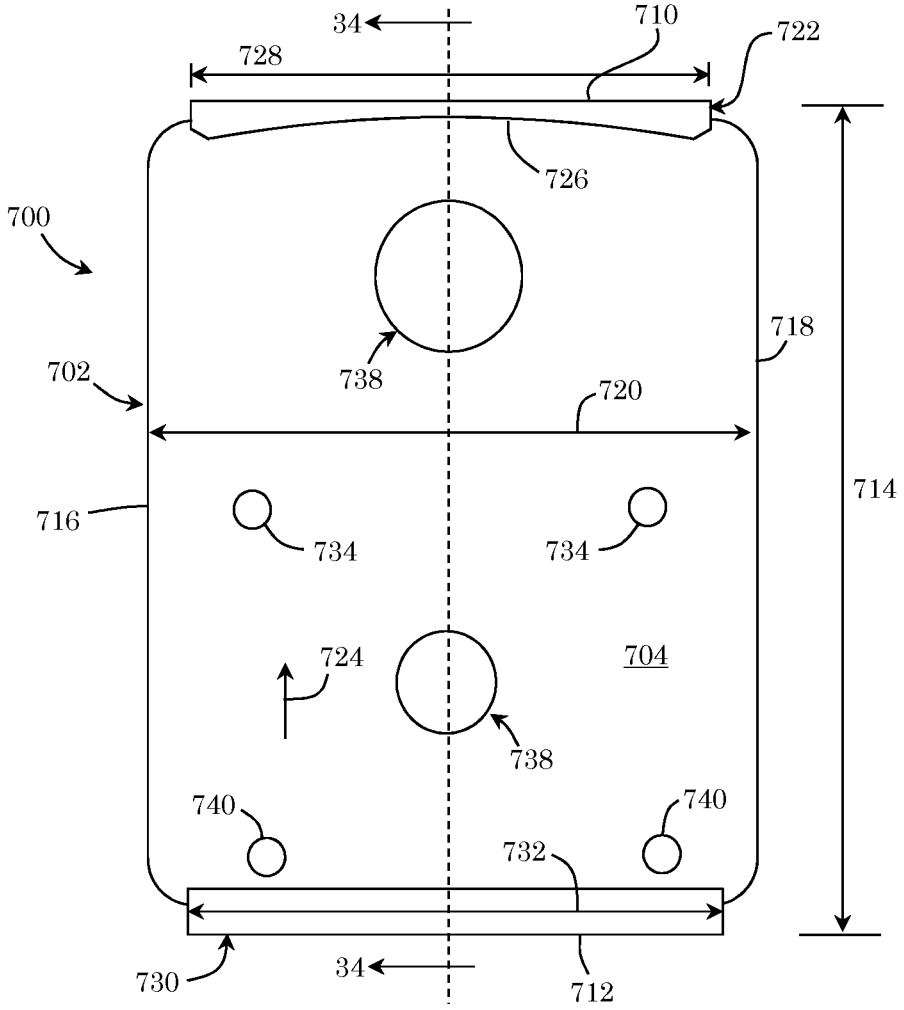
FIG. 33 is a schematic view of a bottom surface of another optical sight adapter according to embodiments of the disclosure.
Figure 34:
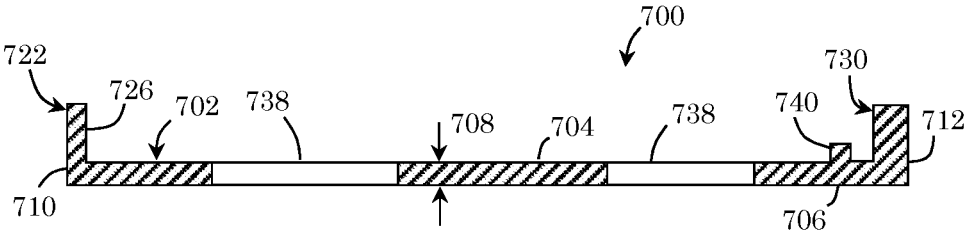
FIG. 34 is a cross-sectional view of the optical sight adapter of FIG. 33 taken along line 34-34.

FIGS. 33 and 34 are a schematic view of a top surface and a longitudinal side cross-sectional view, respectively, of another exemplary optical sight adapter 700. Optical sight adapter 700 comprises an adapter plate 702 including a first (upper) surface 704 and a second (lower) surface 706 (see FIG. 34). In various embodiments, first mounting surface 704 and second mounting surface 706 can be parallel to each other. In various embodiments, first mounting surface 704 and second mounting surface 706 can be generally planar. In some embodiments optical sight adapter 700 can be formed of a polymer (plastic) material, for example by injection molding or 3D printing. However, in further embodiments, optical sight adapter 700 can be metal, for example machined, cast, or 3D-printed metal, such as but not limited to aluminum or an aluminum alloy, or steel.

Optical sight adapter 700 further comprises a forward end 710 and a rear end 712 defining a length 714 therebetween, and a first side edge surface 716 and a second side edge surface 718 defining a width 720 therebetween orthogonal to length 714. Length 714 and width 720 will depend on the design of slide 104 and more particularly the length and width of recessed area 118 and the length and width of optical sight 10. However, by way of example and not limitation, in some embodiments, length 714 can be in a range from about 4 cm to about 6 cm, for example in a range from about 4.2 cm to about 5.5 cm, such as in a range from about 4.5 cm to about 5.2 cm, including all ranges and subranges therebetween, and width 720 can be in a range from about 2.5 cm to about 3 cm, for example in a range from about 2.6 cm to about 2.8 cm, including all ranges and subranges therebetween, although other dimensions as warranted by the handgun design are contemplated. First and second side edge surfaces 716, 718 can, in various embodiments, be flat surfaces and extend parallel to one another. In some embodiments, side edge surfaces 716, 718 can be orthogonal to one or both of first mounting surface 704 and second mounting surface 706. However, in further embodiments, side edge surfaces 716, 718 may include channels, raised areas, or other gripping features used to manipulate slide 104. Such gripping features may correspond to similar gripping features located on slide 104. In some embodiments, at least one of first side edge surface 716 or second side edge surface 718 may comprise a chamfer. In some embodiments, the chamfer may connect with second mounting surface 706 but not first mounting surface 704. That is, only a portion of first side edge surface 716 and/or second side edge surface 718 may be chamfered, such as a bottom portion of each side edge, although in further embodiments, a top portion of each side edge may be chamfered.

Optical sight adapter 700 may further comprise an integral recoil buffer 722 positioned at forward end 710 and extending upright from first mounting surface 704. For example, in some embodiments, recoil buffer 722 may extend orthogonally from first mounting surface 704. Recoil buffer 722 can provide forward support to optical sight 10 during recoil of slide 104 and fill any gap between optical sight 10 and forward surface 140 if optical sight 10 is shorter than recessed area 118. The term "forward," when used in connection with any of the optical sight adapters disclosed herein, refers to a direction from rear end 712 toward forward end 710, e.g., along arrow 724, or positioned closer to forward end 710 than rear end 712. In embodiments, rear-facing support surface 726 may have a shape complementary to forward end 26 of optical sight 10 so that when optical sight 10 is mounted on optical sight adapter 700, contact between forward end 26 of optical sight 10 and support surface 726 can be maximized. A width 728 of recoil buffer 722 can be at least 0.5 times width 720, for example at least about 0.75 times width 720. In some embodiments, width 728 of recoil buffer 722 can be equal to width 720. In some embodiments, optical sight adapter 700 may comprise a second integral recoil buffer 730 extending upright from first mounting surface 704 and positioned at rear end 712. A width 732 of second recoil buffer 730 can be at least 0.5 times width 720, for example at least about 0.75 times width 720. In some embodiments, width 732 of second recoil buffer 730 can be equal to width 720.

First mounting surface 704 can be configured to engage with bottom mounting surface 16 of optical sight 10, while second mounting surface 706 is configured to engage with bottom surface 120 of recessed area 118. Accordingly, optical sight adapter 700, and in particular, adapter plate 702, can function as a mating interface between slide 104 and optical sight 10. In various embodiments, thickness 708 of adapter plate 702 can be in a range from about 1 mm to about 4 mm, for example in a range from about 1 mm to about 3.5 mm, in a range from about 1.0 mm to about 3.0 mm, in a range from about 1.0 mm to about 2.5 mm, in a range from about 1.0 mm to about 2.4 mm, in a range from about 1.0 mm to about 2.2 mm, in a range from about 1.0 mm to about 1.5 mm, or in a range from about 1.0 mm to about 1.2 mm, including all ranges and subranges therebetween.

Adapter plate 702 may include one or more apertures 734 extending through the thickness of adapter plate 702 between first mounting surface 704 and second mounting surface 706, such as a pair of apertures 734, for mounting optical sight adapter 200 to bottom surface 120 of recessed area 118 via threaded fasteners 124. Apertures 734 may comprise a chamfered upper surface connecting to first mounting surface 704. That is, the one or more apertures 734 can be countersunk to receive a fastener head, e.g., screw head. In other embodiments, apertures 734 may not include chamfers. For example, in various embodiments, optical sight 10 may be coupled directly to recessed area 118 by threaded fasteners 42 with optical sight adapter 700 positioned between the optical sight and the recessed area. That is, in various embodiments, optical sight adapter 700 is not separately secured to recessed area 118 after which optical sight 10 is mounted to the optical sight adapter. Rather, optical sight adapter 700 can be placed into recessed area 118 and remain loose, after which optical sight 10 is positioned on optical sight adapter 700, wherein threaded fasteners 42 secure both the optical sight and the optical sight adapter to recessed area 118. In this configuration, optical sight adapter 700 forms a spacing function, wherein the one or more recoil buffers can fill any gap between the optical sight and the forward and rear surfaces 140, 142 of recessed area 118.

Optical sight adapter 700 may further comprise additional apertures 738 extending between and through first mounting surface 704 and second mounting surface 706. The additional apertures 738 may be configured to receive raised orientation features extending from bottom surface 120 of recessed area 118. Accordingly, a size (e.g., diameter) of the additional apertures can be greater than the size (e.g., diameter) of apertures 734 configured to receive threaded fasteners 124. In some embodiments, a diameter of apertures 738 can be greater than 1 times a diameter of an aperture 734, for example in a range from greater than 1 times to about 3 times a diameter of an aperture 734, for example in a range from about 1.5 to about 3 times a diameter of an aperture 734, including all ranges and subranges therebetween. In some embodiments, apertures 734 can have a diameter in a range from about 3.3 mm to about 10 mm, for example in a range from about 4.0 mm to about 10 mm, from about 5 mm to about 10 mm, from about 6 mm to about 9 mm, or from about 6.5 mm to about 8 mm.

In accordance with various embodiments, first mounting surface 704 may further comprise one or more registration pins 740 extending upward, for example orthogonally, from first mounting surface 704. Registration pins 740 may be located at the forward half of adapter plate 202, such as proximate recoil buffer 722. In further embodiments, registration pins 740 may be located in the rear half of adapter plate 702, for example proximate second recoil buffer 730. In some embodiments, registration pins 740 can be located on both a forward half of first mounting surface 704 and a rear half of first mounting surface 704. As illustrated in FIG. 33, first mounting surface 704 may include a pair of registration pins 740. The number and location of the registration pins will be determined by the requirements of the optical sight to be mounted on the firearm. Accordingly, optical sight adapter 700 can comprise a plurality of registration pins positioned at any suitable location on first mounting surface 704. Registration pins 740 may be any suitable cross-sectional shape. For example, registration pins 740 may have a circular cross-sectional shape, a portion of a circular shape, e.g., a semi-circular shape, a rectangular shape, a triangular shape, and so forth.

In accordance with various embodiments, optical sight adapter 700 may include no mounting posts, and no sockets on second mounting surface 706 for receiving removable mounting posts. However, although not shown, optical sight adapter 700 may include removable registration pins as previously described in reference to optical sight adapter 600. Optical sight 10 can be mounted to recessed area 118 by threaded fasteners 42 extending through both optical sight 10 and adapter plate apertures 734 and into threaded passages in recessed area 118.

It will be apparent to those skilled in the art that various modifications and variations can be made to embodiments of the present disclosure without departing from the spirit and scope of the disclosure. For example, although embodiments discussed herein were presented in the context of a handgun, the optical sight adapters disclosed can be used in conjunction with various firearms, such as but not limited to rifles (bolt-operated rifles, lever-operated rifles, gas-operated rifles and piston-operated rifles), semiautomatic handguns, and revolvers. Moreover, aspects of one embodiment may be used with another embodiment. For example, in some embodiments, no removable mounting posts or registration pins may be used, while in other embodiments, a removable mounting post may be present but a fixed registration pin used, while in still other embodiments, a fixed mounting post may be present, but a removable registration pin may be employed, while in still further embodiments, both a removable mounting post and a removable registration pin may be present. In some embodiments, a single recoil buffer may be used, while in further embodiments, two recoil buffers may be used. In some embodiments, orientation features may be employed on the second mounting surface. The orientation features may encompass one or more recesses (e.g., channels), while in other embodiments, the orientation features may comprise one or more protrusions. In some embodiments, there can be multiple orientation features on the second mounting surface. In some embodiments, the orientation features may comprise a combination of one or more recesses and one or more protrusions. Accordingly, any one or more of these various aspects can be combined as needed to accommodate a particular firearm and/or optical sight. Thus, it is intended that the present disclosure cover such modifications and variations provided they come within the scope of the appended claims and their equivalents.

What is claimed is:

1. An adapter for mounting an optical sight to a firearm, comprising:

an adapter plate comprising a first mounting surface and a second mounting surface opposite the first mounting surface, the adapter plate further comprising:

a first socket comprising a first recess extending from the second mounting surface to a first bottom wall located intermediate between the first mounting surface and the second mounting surface, and a first aperture extending from the first bottom wall of the first recess through the first mounting surface along a first longitudinal axis centrally located through the first aperture, wherein a periphery of the first recess is circularly asymmetric relative to the first longitudinal axis; and at least one second aperture extending from the first mounting surface to the second mounting surface, the at least one second aperture comprising a chamfer at the first mounting surface.

2. The adapter of claim 1, wherein the adapter plate further comprises a registration pin extending from the first mounting surface.

3. The adapter of claim 1, wherein the adapter plate comprises a first side edge and a second side edge, the first side edge and the second side edge defining a width of the adapter plate therebetween, the adapter plate further comprising a recoil buffer extending upright from the first mounting surface, the recoil buffer further extending laterally across at least one half the width of the adapter plate.

4. The adapter of claim 3, wherein the recoil buffer comprises a frame defining an opening therethrough.

5. The adapter of claim 1, wherein the second mounting surface comprises at least one orientation feature configured to engage with a surface of the firearm.

6. The adapter of claim 1, wherein the adapter plate comprises a second socket comprising a second recess extending from the second mounting surface to a second bottom wall located intermediate between the first mounting surface and the second mounting surface and a third aperture extending from the second bottom wall through the first mounting surface along a second longitudinal axis, and a periphery of the second recess is circularly asymmetric relative to the second longitudinal axis.

7. A kit of parts for mounting an optical sight to a firearm, comprising:

an adapter plate comprising a first mounting surface and a second mounting surface opposite the first mounting surface, the adapter plate further comprising:

a first socket comprising a first recess extending from the second mounting surface to a first bottom wall located intermediate between the first mounting surface and the second mounting surface and a first aperture extending from the first bottom wall of the first recess through the first mounting surface along a first longitudinal axis centrally located through the first aperture; and a mounting post comprising a flange and a shaft extending from the flange along a second longitudinal axis, the shaft comprising an interior threaded passage, the mounting post configured to engage in the first socket such that the shaft extends through the first aperture and above the first mounting surface, the mounting post configured to resist rotation when engaged in the first socket and subjected to a torque.

8. The kit of parts of claim 7, wherein the shaft extends at least about 1 mm above the first mounting surface when the mounting post is engaged in the socket.

9. The kit of parts of claim 7, wherein the adapter plate further comprises a recoil buffer extending upright from the first mounting surface, a width of the recoil buffer equal to or greater than about 0.5 times a width of the adapter plate defined between a first side edge and a second side edge of the adapter plate.

10. The kit of parts of claim 7, wherein a shape of the flange is complementary to a shape of the first recess.

11. The kit of parts of claim 10, wherein a periphery of the first recess is circularly asymmetric relative to the first longitudinal axis.

12. The kit of parts of claim 7, wherein the adapter plate comprises a second socket comprising a second recess extending from the second mounting surface to a second bottom wall located intermediate between the first mounting surface and the second mounting surface and a second aperture extending from the second bottom wall through the first mounting surface along a third longitudinal axis, and a periphery of the second recess is circularly asymmetric relative to the third longitudinal axis.

13. The kit of parts of claim 12, further comprising a registration pin extending upright from the first mounting surface.

14. The kit of parts of claim 9, wherein a height of the recoil buffer is equal to or greater than about 0.25 times a length of the adapter plate, the recoil buffer comprising a frame defining an opening therethrough.

15. The kit of parts of claim 14, wherein a width of the opening is in a range from about 2 cm to about 3 cm.

16. The kit of parts of claim 7, wherein the second mounting surface comprises at least one orientation feature configured to engage with a surface of the firearm.

17. A kit of parts for mounting an optical sight to a firearm, comprising:

an adapter plate comprising a first mounting surface and a second mounting surface opposite the first mounting surface, the adapter plate further comprising:

a socket comprising a recess extending from the second mounting surface to a bottom wall located intermediate between the first mounting surface and the second mounting surface and a first aperture extending from the bottom wall of the recess through the first mounting surface along a first longitudinal axis centrally located through the first aperture, the recess having a peripheral shape such that a line segment extending orthogonally from the first longitudinal axis and terminating at a side wall of the recess varies in length as the line segment is rotated about the first longitudinal axis; and a mounting post comprising a flange and a shaft extending from the flange along a second longitudinal axis, the shaft comprising a threaded passage, the mounting post configured to removably engage in the socket such that the shaft extends through the first aperture and above the first mounting surface at least one millimeter.

18. The kit of parts of claim 17, wherein the adapter plate comprises a first side edge and a second side edge, the first side edge and the second side edge defining a width therebetween, the adapter plate further comprising a recoil buffer extending upright from the first mounting surface, the recoil buffer further extending laterally across at least one half the width of the adapter plate.

19. The kit of parts of claim 17, wherein the adapter plate comprises a frame integral with the adapter plate, the frame arranged to cover at least a part of a forward-facing portion of the optical sight when the optical sight is attached to the first mounting surface of the adapter plate.

20. The kit of parts of claim 17, wherein the mounting post is configured to resist rotation when engaged in the socket and subjected to a torque.

21. The kit of parts of claim 17, wherein a peripheral shape of the flange is substantially the same as the peripheral shape of the recess.

22. The kit of parts of claim 17, wherein the adapter plate comprises a second aperture extending through a thickness of the adapter plate from the first mounting surface to the second mounting surface, the second aperture configured to receive a fastener therethrough that fastens the adapter plate to the firearm.

23. The kit of parts of claim 17, further comprising a threaded fastener configured to engage with the threaded passage.

* * * * *